US012650069B2

(12) United States Patent
Johnson

(10) Patent No.: US 12,650,069 B2
(45) Date of Patent: Jun. 9, 2026

(54) DEVICES, SYSTEMS, AND METHODS FOR HIGH FREQUENCY OSCILLATION MITIGATION

(71) Applicant: Schlumberger Technology Corporation, Sugar Land, TX (US)

(72) Inventor: Ashley Bernard Johnson, Cambridge (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 1013 days.

(21) Appl. No.: 17/807,390

(22) Filed: Jun. 17, 2022

(65) Prior Publication Data

US 2022/0403731 A1 Dec. 22, 2022

Related U.S. Application Data

(60) Provisional application No. 63/260,846, filed on Sep. 2, 2021, provisional application No. 63/202,654, filed on Jun. 18, 2021.

(51) Int. Cl.
*E21B 44/08* (2006.01)

(52) U.S. Cl.
CPC ..... *E21B 44/08* (2013.01); *E21B 2200/20* (2020.05)

(58) Field of Classification Search
CPC ..... E21B 44/08; E21B 2200/20; E21B 4/02; E21B 17/1078; E21B 17/10; E21B 15/00;
(Continued)

(56) References Cited

U.S. PATENT DOCUMENTS 6,516,293 B1 2/2003 Huang et al.
6,785,641 B1 8/2004 Huang
(Continued)

FOREIGN PATENT DOCUMENTS

WO 2021202484 A1 10/2021

OTHER PUBLICATIONS

Bailey, J.R.. R., and S.M.. M. Remmert. "Managing Drilling Vibrations Through BHA Design Optimization." SPE Drill & Compl 25 (2010): 458-471. doi: https://doi.org/10.2118/139426-PA (Year: 2010).*
(Continued)

*Primary Examiner* — Eunhee Kim
(74) *Attorney, Agent, or Firm* — Jeffrey D. Frantz

(57) ABSTRACT

High frequency oscillation (HFO) comes in at least two types. Type 1 HFO is lower frequency and often associated with a motor. Type 2 HFO is higher frequency and often independent of a motor. To mitigate torsional strain due to Type 2 HFO, an HFO mitigation mechanism can be placed based on an oscillation node location to move the oscillation node to a new position which may be uphole of a tool or the BHA, or to a less vulnerable location. Mitigation can also include placing an energy damping component based on the oscillation node. This may be at a high displacement location distanced from the oscillation node, or may include placement at the oscillation node with an additional HFO mitigation mechanism to move the oscillation node away from the installation location. Oscillations may be damped by using any combination of flow restrictions, fluid bypasses, or axially compliant elements.

20 Claims, 14 Drawing Sheets

(58) Field of Classification Search
CPC . E21B 7/24; E21B 17/07; E21B 21/00; E21B 41/00; E21B 17/00; E21B 47/007; E21B 44/04
See application file for complete search history.

(56) References Cited

U.S. PATENT DOCUMENTS

| | | | | |
|---|---|---|---|---|
| 6,873,947 | B1 | 3/2005 | Huang et al. | |
| 7,020,597 | B2 | 3/2006 | Oliver et al. | |
| 7,139,689 | B2 | 11/2006 | Huang | |
| 7,260,514 | B2 | 8/2007 | Huang | |
| 7,464,013 | B2 | 12/2008 | Huang et al. | |
| 7,693,695 | B2 | 4/2010 | Huang et al. | |
| 7,844,426 | B2 | 11/2010 | Huang | |
| 7,899,658 | B2 | 3/2011 | Oliver et al. | |
| 8,066,085 | B2 * | 11/2011 | Johnson | E21B 44/005 175/266 |
| 8,401,831 | B2 | 3/2013 | Tang et al. | |
| 8,812,281 | B2 | 8/2014 | Tang et al. | |
| 9,476,261 | B2 * | 10/2016 | Venugopal | E21B 47/017 |
| 9,482,055 | B2 | 11/2016 | Huang | |
| 10,920,502 | B2 | 2/2021 | Al-Qasim et al. | |
| 11,021,945 | B2 | 6/2021 | Hohl et al. | |
| 2004/0143427 | A1 | 7/2004 | Huang et al. | |
| 2007/0067147 | A1 | 3/2007 | Huang | |
| 2010/0032165 | A1 * | 2/2010 | Bailey | E21B 41/00 703/7 |
| 2013/0319684 | A1 | 12/2013 | Moellendick | |
| 2017/0030166 | A1 | 2/2017 | Shen et al. | |
| 2019/0284881 | A1 * | 9/2019 | Hohl | E21B 17/073 |
| 2019/0284882 | A1 * | 9/2019 | Peters | E21B 17/073 |
| 2022/0112775 | A1 | 4/2022 | Peters et al. | |

OTHER PUBLICATIONS

Wilson JK. Field validation of a new bottomhole-assembly model for unconventional shale plays. SPE Drilling & Completion. Jun. 13, 2019;34(02):189-206. (Year: 2019).*

Shen Y, Chen W, Zhang Z, Bowler A, Jeffryes B, Chen Z, Carrasquilla MN, Smith D, Skoff G, Panayirci HM, Arevalo Y. Drilling dynamics model to mitigate high frequency torsional oscillation. InSPE/IADC Drilling Conference and Exhibition Feb. 2, 20205 (p. D081S004R001). SPE. (Year: 2020).*

Sugiura J, Jones S. Simulation and measurement of high-frequency torsional oscillation (HFTO)/high-frequency axial oscillation (HFAO) and downhole HFTO mitigation: Knowledge gains continue using embedded high-frequency drilling dynamics sensors. SPE Drilling & Completion. Dec. 17, 2020;35(04):553-75. (Year: 2020).*

Combined Search and Examination Report in U.K. Patent Application No. GB2208981.7, dated Nov. 10, 2022, 6 bages.

Sugiura et al., Simulation and Measurement of High-Frequency Torsional Oscillation (HFTO)/High-Frequency Axial Oscillation (HFAO) and Downhole HFTO Mitigation: Knowledge Gains Continue Using Embedded High-Frequency Drilling Dynamics Sensors, SPE-199658-PA, SPE Drill Compl 35 (04), pp. 553-575, 2020.

Tomax, Anti Stick-Slip Tool, retrieved from https://tomax.no/products/gclid=CjOKCQjw-LOEBhDCARIsABrC0TI7i0IMRFfX5-t_iCZIDRo2ztylKe1SAiEtqBNX8z6CvFdVT-b5MlgaAnusEALw_wcB, 1 page.

* cited by examiner

DEVICES, SYSTEMS, AND METHODS FOR HIGH FREQUENCY OSCILLATION MITIGATION

CROSS-REFERENCE TO RELATED APPLICATIONS

This application claims the benefit of, and priority to, U.S. Patent Application No. 63/202,654 filed Jun. 18, 2021 and titled "Mitigation of High Frequency Oscillations" and to U.S. Patent Application No. 63/260,846, filed Sep. 2, 2021 and titled "Devices, Systems, and Methods for High Frequency Torsional Oscillation Mitigation". Each of the foregoing is expressly incorporated herein by this reference in its entirety.

BACKGROUND

When exploring for or producing water, hydrocarbons, geothermal energy, or other natural resources, wellbores can be drilled into a subterranean formation. An example wellbore can be drilled using a drill string suspended from surface equipment (e.g., a rig or platform). The bottom of the drill string connects to a bottomhole assembly that includes one or more drill bits or other drilling tools for removing or degrading formation, performing measurements, steering the BHA, communicating to the surface, and the like.

While drilling the wellbore, the bottomhole assembly is subjected to a variety of forces and conditions, including reactive forces from the subterranean formation or hydraulic forces from fluids in the formation or in the drill string. Operation of the bottomhole assembly and resulting forces on the bottomhole assembly can result in vibrations within the bottomhole assembly, and the extent or magnitude of the vibrations can vary for myriad reasons, including the design of the bottomhole assembly or drilling tools, type of fluid in the drill string, type of formation or downhole conditions encountered, or the drilling operation being performed. When vibration occurs, energy that could otherwise be used for drilling is displaced and converted to vibration, and therefore reduces the efficiency of the drilling operation. As a result, rate of penetration may be reduced and time to target may be increased. Vibration may also detrimentally impact electronic components, interfere with communication or measurements, or lead to fatigue or wear of components or parts of the bottomhole assembly.

SUMMARY

In some embodiments, a method for mitigating torsional oscillation includes modeling bending associated with high frequency torsional oscillation in a downhole system for use in a wellbore. Based on the bending model, one or more contact regions or oscillation nodes are identified. The design of the downhole system is modified at the contact region or oscillation node to move the oscillation node toward the surface of the wellbore. In some embodiments, this may include determining an installation location of an HFTO mitigation mechanism. In some embodiments, the HFTO mitigation mechanism may include a wear band installed on an outer surface of the downhole drilling system.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 7-1 and FIG. 7-2 are representations of a portion of a dogleg, according to at least one embodiment of the present disclosure;

DETAILED DESCRIPTION

Figure 1:
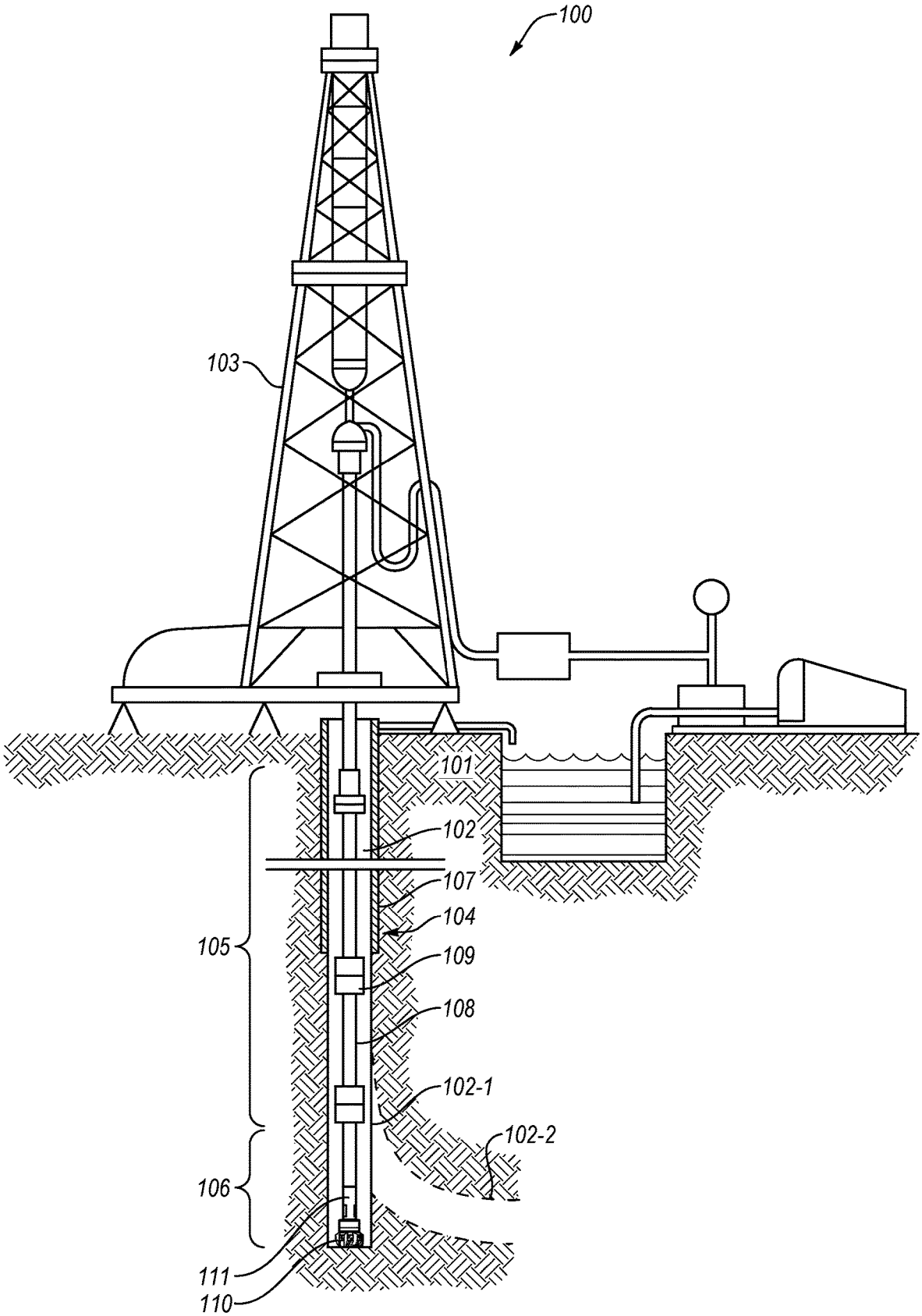
FIG. 1 is a representation of a downhole drilling system, according to at least one embodiment of the present disclosure.

Embodiments of this disclosure generally relate to devices, systems, and methods for mitigating torsional oscillations of a downhole drilling tool. Torsional oscillations are generated in a downhole drilling system during drilling activities. An oscillation node for the torsional oscillations may be located at contact points between the downhole drilling system and the wellbore well. Torsional stresses at the oscillation node may cause failure of one or more structural components of the downhole drilling system. An oscillation mitigation mechanism may be placed on the downhole tool in a location that causes the oscillation node to be moved away from components that can be damaged by the oscillation. Moving the oscillation node away from the downhole drilling system may help to reduce or prevent structural damage caused by torsional stresses at the oscillation node.

In accordance with embodiments of the present disclosure, oscillation mitigation mechanisms may reduce a contact length of the downhole drilling with the wellbore wall. For example, an oscillation mitigation mechanism may include one or more fixed or rotating sleeves that are installed on or around the outer surface of the downhole drilling tool. The one or more sleeves may increase the outer diameter of the downhole drilling tool over a short length. This may prevent the outer surface, or at least a portion of the outer surface, of the downhole drilling tool from contacting the wellbore wall. This may reduce the contact length, thereby changing the location of an oscillation node that may occur in a region of extended contact. As discussed in further detail herein, this may help to reduce or prevent structural damage caused by torsional stresses at the oscillation node.

In accordance with embodiments of the present disclosure, the location of the extended contact points may be identified using a computer model of the wellbore. For example, a drilling operator may model the bending associated with following the trajectory of the hole. Based on the bending model, the drilling operator may identify contact points and the length of the contact points of the downhole drilling system with the wellbore wall. The bending model may vary based on environmental or operational parameters. For instance, the wellbore trajectory, weight on bit, rotational speed, tool configuration, mud pressure/flow rate, mud composition, formation strength, formation type, etc. may change the extent of contact and amount of friction at a location on the drill string, and thus whether an oscillation node may form. With the contact points identified by modeling or in some other manner (e.g., user experience), the drilling operator may then determine whether the contact points are likely to be associated with an oscillation node. This could include modeling or simulation, analysis of tools from offset wells or other wells with similar conditions, user experience, and the like. If the contact points are likely associated with an oscillation node, the operator may then modify the design of the downhole drilling system to include a mitigation mechanism to move the oscillation node away from components that could be damaged by HFTO. For instance, the mitigation mechanism may move the oscillation node of the downhole drilling system in an uphole direction. In some cases, identifying the node may be used to identify placement of a damping mechanism. For instance, the damping mechanism may be placed between multiple nodes or spaced away from a node. The modified system may then be used to perform a wellbore operation, such as a drilling or remedial operation in a deviated wellbore.

By way of background, FIG. 1 shows one example of a drilling system 100 for drilling an earth formation 101 to form a wellbore 102. The drilling system 100 includes a drill rig 103 used to turn a drilling tool assembly 104 which extends downward into the wellbore 102. The drilling tool assembly 104 may include a drill string 105, a bottomhole assembly (BHA) 106, and a bit 110, attached to the downhole end of drill string 105.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 may further include additional components such as subs, pup joints, etc. The drill pipe 108 provides a hydraulic passage through which drilling fluid is pumped from the surface. The drilling fluid discharges through nozzles, jets, or other orifices in the bit 110 for the purposes of cooling the bit 110 and cutting structures thereon, for lifting cuttings out of the wellbore 102 as it is being drilled, for controlling influx of fluids in the well, for maintaining the wellbore integrity, and for other purposes.

The BHA 106 may include the bit 110 or other components. An example BHA 106 may include additional or other components (e.g., coupled between to the drill string 105 and the bit 110). Examples of additional BHA components include drill collars, stabilizers, measurement-while-drilling (MWD) tools, logging-while-drilling (LWD) tools, downhole motors, underreamers, section mills, hydraulic disconnects, jars, vibration or damping tools, other components, or combinations of the foregoing. The BHA 106 may further include a directional tool 111 such as a bent housing motor or a rotary steerable system (RSS). The directional tool 111 may include directional drilling tools that change a direction of the bit 110, and thereby the trajectory of the wellbore. In some cases, at least a portion of the directional tool 111 may maintain a geostationary position relative to an absolute reference frame, such as gravity, magnetic north, or true north. Using measurements obtained with the geostationary position, the directional tool 111 may locate the bit 110, change the course of the bit 110, and direct the directional tool 111 on a projected trajectory. For instance, although the BHA 106 is shown as drilling a vertical portion 102-1 of the wellbore 102, the BHA 106 (including the directional tool 111) may instead drill directional or deviated well portions, such as directional portion 102-2.

In general, the drilling system 100 may include additional or other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on their locations in the drilling system 100.

In some embodiments, the BHA 106 may include a downhole motor to power downhole systems and/or provide rotational energy for downhole components (e.g., rotate the bit 110, drive the directional tool 111, etc.). The downhole motor may be any type of downhole motor, including a positive displacement pump (such as a progressive cavity motor) or a turbine. In some embodiments, a downhole motor may be powered by the drilling fluid flowing through the drill pipe 108. In other words, the drilling fluid pumped downhole from the surface may provide the energy to rotate a rotor in the downhole motor. The downhole motor may operate with an optimal pressure differential or pressure differential range. The optimal pressure differential may be the pressure differential at which the downhole motor may not stall, burn out, overspin, or otherwise be damaged. In some cases, the downhole motor may rotate the bit 110 such that the drill string 105 may not be rotated at the surface, or may rotate at a different rate (e.g., slower) than the rotation of the bit 110.

The bit 110 in the BHA 106 may be any type of bit suitable for degrading downhole materials such as earth formation 101. Example types of drill bits used for drilling earth formations are fixed-cutter or drag bits, roller cone bits, and combinations thereof. In other embodiments, the bit 110 may be a mill used for removing metal, composite, elastomer, other downhole materials, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface or may be allowed to fall downhole. In still other embodiments, the bit 110 may include a reamer. For instance, an underreamer may be used in connection with a drill bit and the drill bit may bore into the formation while the underreamer enlarges the size of the bore.

During drilling, the BHA 106 will experience various vibrational and other forces, and the forces may vary (oftentimes significantly) between different tools or positions in the BHA 106. For instance, the directional tool 111 may include a mud motor or RSS, and torsional oscillations and resonance may occur below the directional tool 111 (or below the RSS or motor thereof). The oscillations and resonance below the directional tool 111 may be significantly different from oscillations above the motor or RSS. In some cases, pressure perturbations may drive oscillations through steering pads or cutters in an RSS, and may not be as significant in other parts of the BHA 106.

High frequency torsional oscillations (HFTO) are a particular category of oscillations that occur within drilling tools and which can have a destructive impact. HFTO may be found in a frequency range of 60 to 350 Hz (along with harmonics) and can be primarily torsional; however, it should be understood that, in some situations, there may be a strong axial component accompanying HFTO. For instance, axial oscillations can be seen with frequencies up to 1200 Hz. In some cases, the axial component can even be dominant over the torsional oscillations. This behavior can be observed with a definitive correlation to acoustic noise in the mud system. Accordingly, high frequency oscillations (HFO) can be both torsional and axial in some embodiments. As used herein, HFO and HFTO may be considered for use interchangeably, and both can include torsional and axial oscillations. For instance, HFO with primarily axial oscillations may nonetheless be considered HFTO as the axial oscillations can be coupled to torsional oscillation or motion.

Two types of HFTO are discussed in accordance with embodiments of the present disclosure, although other types and categories of HFTO and HFO may exist. Type 1 HFTO may be associated with, for example, a drilling motor-powered RSS in a downhole drilling system. For example, Type 1 HFTO may be associated with a downhole motor in the drilling system. In some embodiments, the rotation of the downhole motor (e.g., the turbine, the rotor, or other rotatable element of the downhole motor) may cause or contribute to Type 1 HFTO. Type 1 HFTO may have a relatively low frequency and can include a single oscillation node. For example, Type 1 HFTO may have a frequency of less than 300 Hz, with some harmonics. In some embodiments, Type 1 HFTO may be associated with vertical or lateral wellbore drilling, and can affect the length of the BHA below the motor.

Type 2 HFTO may have a relatively higher frequency of greater than 300 Hz, or between 150 Hz and 350 Hz, and potentially with many harmonics. In some situations, Type 2 HFTO may occur in downhole drilling systems that include a downhole motor. In some situations, Type 2 HFTO may also occur in downhole drilling systems that do not include a downhole motor. Thus, the existence of Type 2 HFTO can generally be independent of the presence and/or operation of a downhole motor. In some embodiments, Type 2 HFTO may be present or located closer to the bit than Type 1 HFTO. Type 1 HFTO and Type 2 HFTO may also be mutually exclusive. Put another way, when Type 1 HFTO is present, significant Type 2 HFTO may not be present, and when Type 2 HFTO is present, significant Type 1 HFTO may not be present.

In accordance with embodiments of the present disclosure, Type 2 HFTO may be present in a curved section of a wellbore. Put another way, Type 2 HFTO may exist while the BHA bends and curves through a dogleg of a wellbore. In some embodiments, Type 2 HFTO may be present while drilling through the dogleg, or while drilling a lateral section while the BHA is still located within the dogleg. In some embodiments, Type 2 HFTO may be more likely to occur, or more severe, in wellbores having smaller radius of curvature (e.g., a tighter dogleg).

Conventionally, to mitigate HFTO, an energy damping system may be installed in the BHA. Energy damping systems may include movable elements within the BHA or drill string that absorb vibrations and oscillations. Such energy damping systems may help to reduce the magnitude and/or frequency of the HFTO. However, these conventional approaches do not consider the location of nodes (or touch points with the wellbore that affect node locations as discussed herein). Such energy damping systems are typically most effective at locations along the BHA or drill string that experience movement, rather than at nodes where there is high strain but low displacement, but conventional approaches don't distinguish between locations. As discussed herein, the vibrations from HFTO may form a wave in the BHA.

Figure 2:
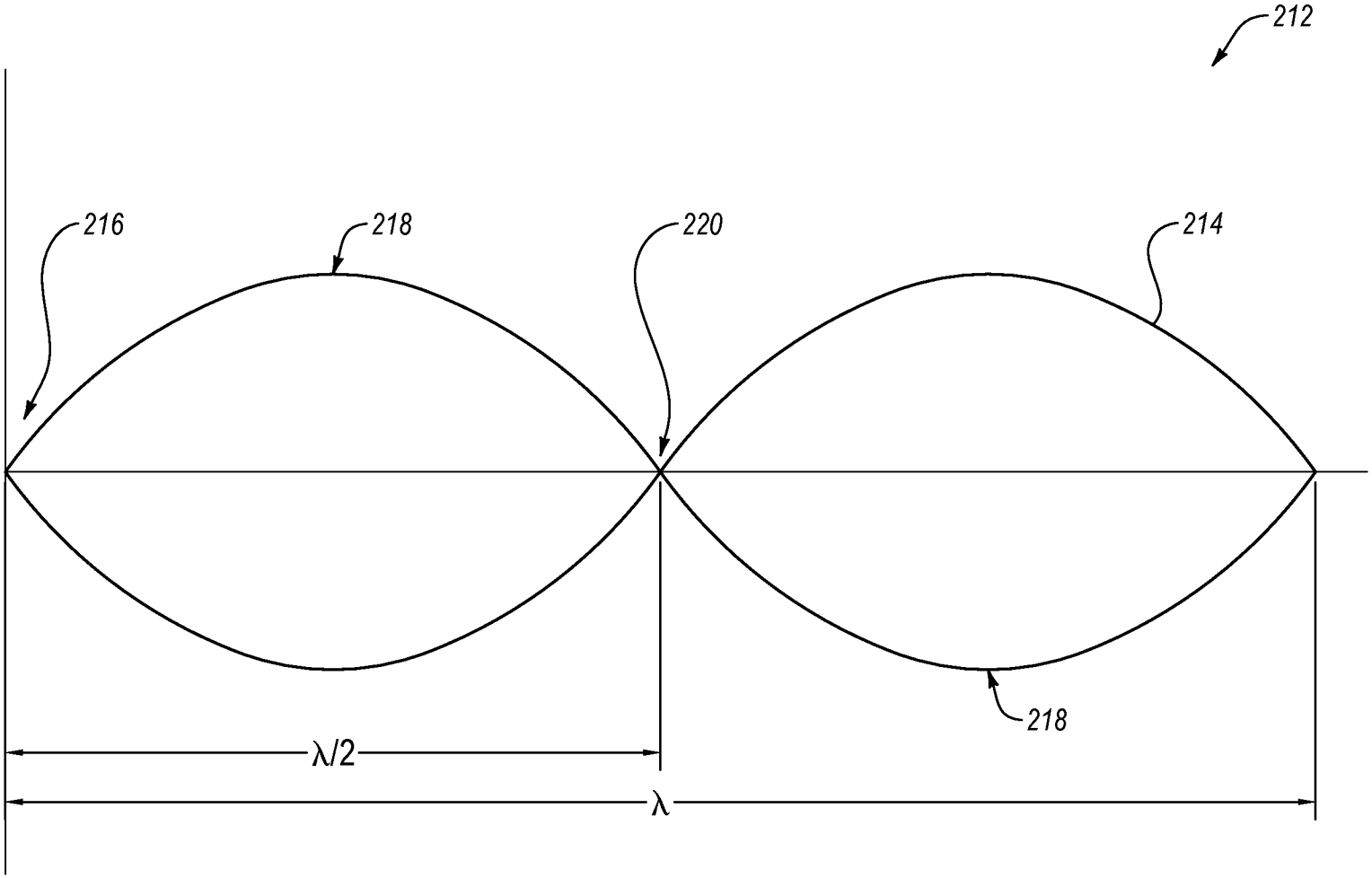
FIG. 2 is a representation of a waveform plot of high frequency torsional oscillation, according to at least one embodiment of the present disclosure.

FIG. 2 is a waveform plot 212 of an HFTO waveform 214, with distance on the horizontal axis (e.g., x-axis) and amplitude on the vertical axis (e.g., y-axis), according to at least one embodiment of the present disclosure. The HFTO waveform 214 may have a wavelength of $\lambda$. The wavelength $\lambda$ may be the distance from a vibration or oscillation origin 216. As may be seen, the HFTO waveform 214 generally follows a sine wave, starting from the oscillation origin 216.

The HFTO waveform 214 may increase in amplitude until it reaches a peak 218 or maximum amplitude. The amplitude may be considered the displacement distance of the BHA or drill pipe during HFTO. Thus, at the peak 218 of the HFTO waveform 214, the BHA may experience the maximum vibrational displacement.

After the peak 218, the HFTO waveform 214 may reduce in amplitude until an oscillation node 220. The oscillation node 220 may be half of the wavelength λ, or λ/2. At the oscillation node 220, the amplitude is zero. This may result in no or limited displacement of the BHA during HFTO. The HFTO waveform 214 may then increase in amplitude past the oscillation node 220 (in the opposite direction) until reaching a peak 218 in the opposite direction. As discussed herein, displacement may be maximized at the respective peaks 218.

While experiencing minimized displacement at the oscillation node 220, torsional strain due to HFTO may be maximized at the oscillation node 220. In some situations, HFTO torsional strain may result in damage to the BHA. For example, HFTO torsional strain may result in weakening or failure (e.g., through cracking or breaking) of the housing or sub of an element of the BHA. In some examples, HFTO torsional strain may result in cracks or other breaks in plugs. In some examples, HFTO torsional strain may result in the buckling of a battery, electronics board, or other element of the BHA. In some examples, HFTO torsional strain may result in damage to a torquer (e.g., upper torquer) of an RSS. Damage to the elements of the BHA may result in additional cost for repair, additional time to trip out of the wellbore, time and costs to replace damaged units, or even catastrophic failure of the BHA and separation of the BHA from the drill string.

As discussed herein, conventionally, to mitigate HFTO, an energy damping tool may be installed on the BHA; however, such energy damping tools typically mitigate the amplitude of the HFTO waveform 214, but don't significantly change the torsional strain at the oscillation node 220 or the location of the oscillation node 220. Furthermore, such energy damping tools typically function by absorbing vibrational energy, and would therefore be most effective when placed at the peak 218 of the HFTO waveform 214—while having reduced effectiveness if placed close to or at the oscillation node 220—but so far a lack of understanding of Type 2 HFTO has not allowed such placement.

In accordance with embodiments of the present disclosure, increasing the wavelength λ is one way to change the location of the oscillation node 220. For example, increasing the wavelength λ may move the oscillation node 220 uphole (e.g., toward the surface) and away from the BHA or sensitive components of the BHA. In some embodiments, by moving the oscillation node 220 away from the BHA or components thereof, damage to the BHA may be reduced or eliminated, thereby saving the drilling operator money. In accordance with embodiments of the present disclosure, the oscillation node 220 may be moved by changing the HFTO waveform 214, or vice versa.

Figure 3:
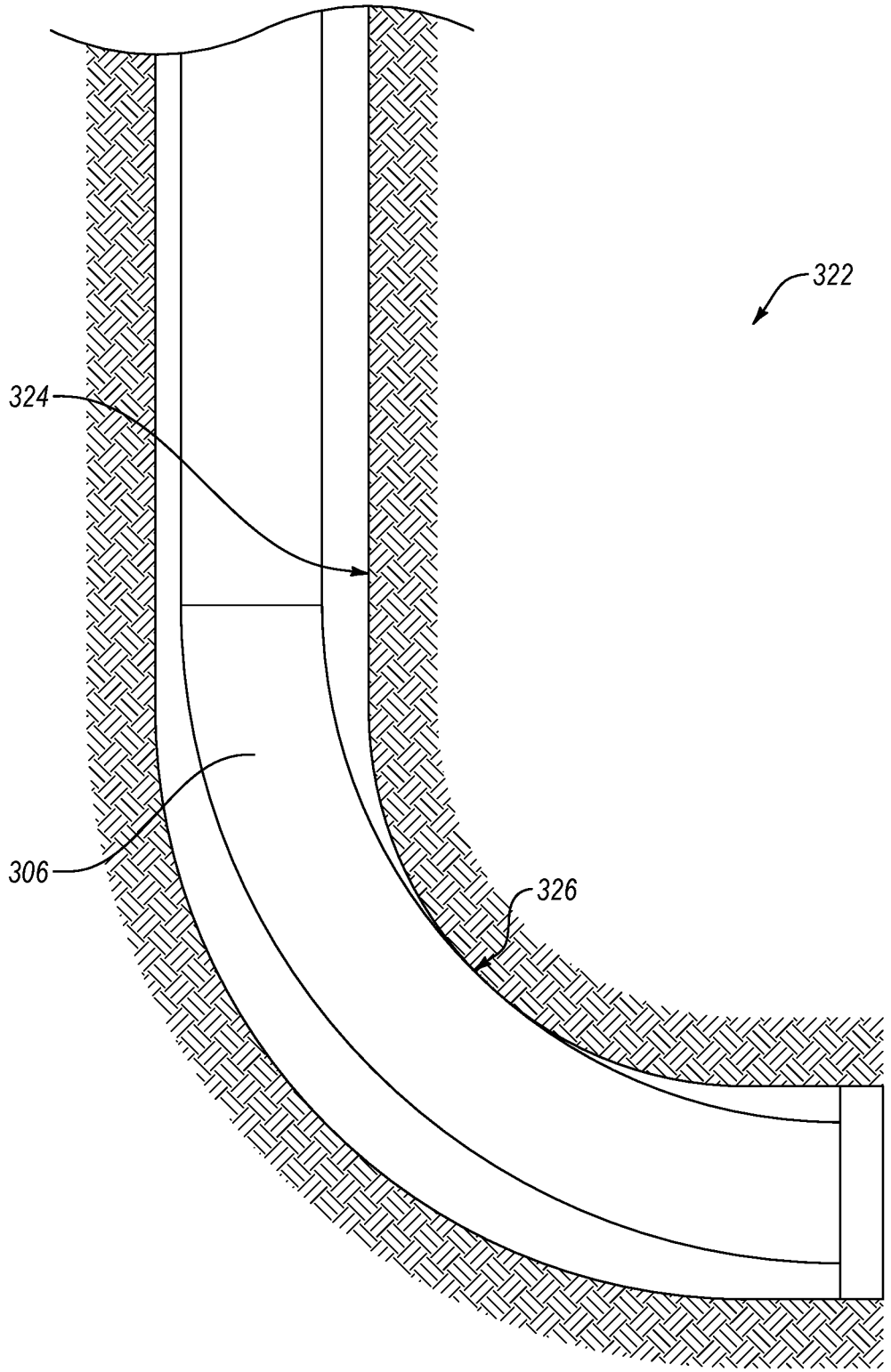
FIG. 3 is a representation of a dogleg in a wellbore, according to at least one embodiment of the present disclosure.

Surprisingly, it was found that the oscillation node 220 was associated with certain contacts between the BHA with the wellbore wall. It has been determined that contact with the wellbore wall may force the contact location to operate as the location of the oscillation node 220. As seen in the schematic wellbore dogleg 322 of FIG. 3, a BHA 306 may be bent to generally conform to the dogleg 322 or curved section of the wellbore. During bending, the BHA 306 may contact the wellbore wall 324 in a contact region 326. Contact of the BHA 306 with the wellbore wall 324 may increase friction and stiffen the BHA 306 at that location, thereby preventing the BHA 306 from certain types of vibration (e.g., Type 2 HFTO) or reducing certain types of vibration of the BHA 306 in the contact region 326. In some embodiments, this may cause an oscillation node (e.g., oscillation node 220 of FIG. 2) to form at the contact region 326. Surprisingly, it was found that an extended contact length may result in an oscillation node, while a reduced contact length may not form an oscillation node.

In some embodiments, the contact region 326 has a contact length that causes an oscillation node to form. In some embodiments, the contact length is in a range having an upper value, a lower value, or upper and lower values including any of 1 ft. (30.5 cm), 1.5 ft. (45.7 cm), 2 ft. (61.0 cm), 3 ft. (91.4 cm), 4 ft. (1.2 m), 5 ft. (1.5 m), 6 ft. (1.8 m), 7 ft. (2.1 m), 8 ft. (2.4 m), 9 ft. (2.7 m), 10 ft. (3.1 m), or any value therebetween. For example, the contact length may be greater than 1 ft. (30.5 cm). In another example, the contact length may be less than 10 ft. (3.05 m). In yet other examples, the contact length may be any value in a range between 1 ft. (30.5 cm) and 10 ft. (3.05 m). In some embodiments, it may be critical that the contact length is greater than 1.5 ft. (45.7 cm) for the contact with the wellbore wall 324 to generate an oscillation node. In other embodiments, the contact length that causes an oscillation node to form may be less than 1 ft. (30.5 cm), or the contact length may be dependent on the wellbore size or tool weight.

Figure 4:
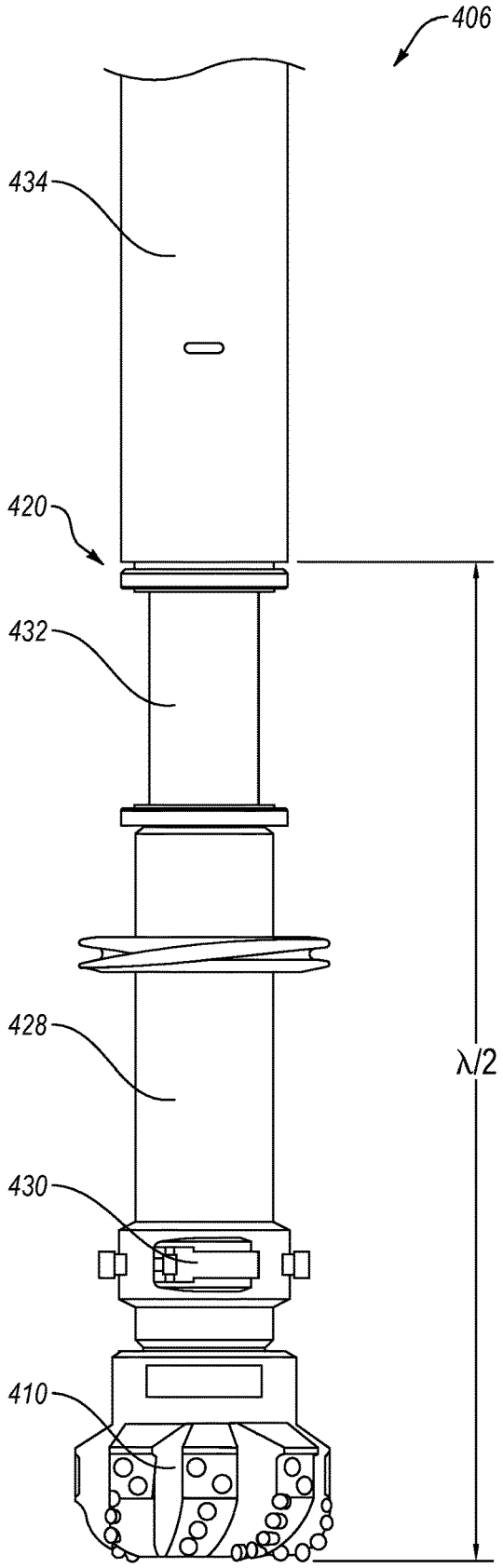
FIG. 4 is a representation of a bottomhole assembly, according to at least one embodiment of the present disclosure.

FIG. 4 is a representation of a BHA 406, according to at least one embodiment of the present disclosure. The BHA 406 includes a bit 410 connected to an RSS 428. The RSS 428 includes a plurality of steering pads 430. Contact with the steering pads 430 against the wellbore wall may change the direction of the bit 410. The contact of the steering pads 430 with the wellbore wall may not be sufficient to create an oscillation node.

The BHA 406 may include one or more downhole tools 432, such as a telescoping or expanding tool, a flex joint, or other downhole tools 432. The BHA 406 may further include one or more additional subs 434, such as an MWD, an LWD, a mud motor, a reamer, or any other sub 434. As may be seen, the diameter of the RSS 428 and the downhole tool 432 may be less than the diameter of the sub 434. While drilling a dogleg, the sub 434 may contact the wellbore wall. In some embodiments, a contact location with the wellbore wall may have a contact length sufficient to generate an oscillation node (schematically represented at 420). As discussed herein, the oscillation node 420 may be located a length λ/2 away from the bit 410, which acts as another node. Torsional strain at the oscillation node 420 may result in damage to one or more portions of the BHA 406, including the downhole tool 432, the sub 434, and/or internal components thereof.

While FIG. 4 illustrates oscillation nodes at the bit 410 and 420, it will be appreciated that a BHA can be a complex system with multiple nodes and contact points along a BHA or drill string. For instance, a directional drilling BHA may include a drill bit and an underreamer. Both the drill bit and underreamer may be used in an underreaming-while-drilling operation to degrade the formation, and both may form high friction oscillation nodes. A contact point between the bit 410 and underreamer may therefore define a first length $\lambda_1/2$ with the bit 410 for HFO (e.g., Type 2), and a contact point either below or above the underreamer may form second length $\lambda_2/2$ with the underreamer for HFO (e.g., Type 2). The first and second lengths may be the same or different. Consequently, the locations of the contact points associated with nodes at the bit 410 and underreamer (for example)

may be evaluated in accordance with embodiments of the present disclosure to change the HFTO waveform and contact point/node location, or the location of an HFO mitigation device. By changing the associated oscillation node location for the bit 410 or underreamer, the displacement/amplitude, frequency, or other portions of the waveform may be changed. For instance, by increasing the λ/2 length, the oscillation frequency may decrease. By decreasing oscillation frequency, the strain at the oscillation node may also decrease. Decreased oscillation frequency also results in fewer cycles over time, thereby reducing the likelihood of failure or damage due to fatigue.

Figure 5:
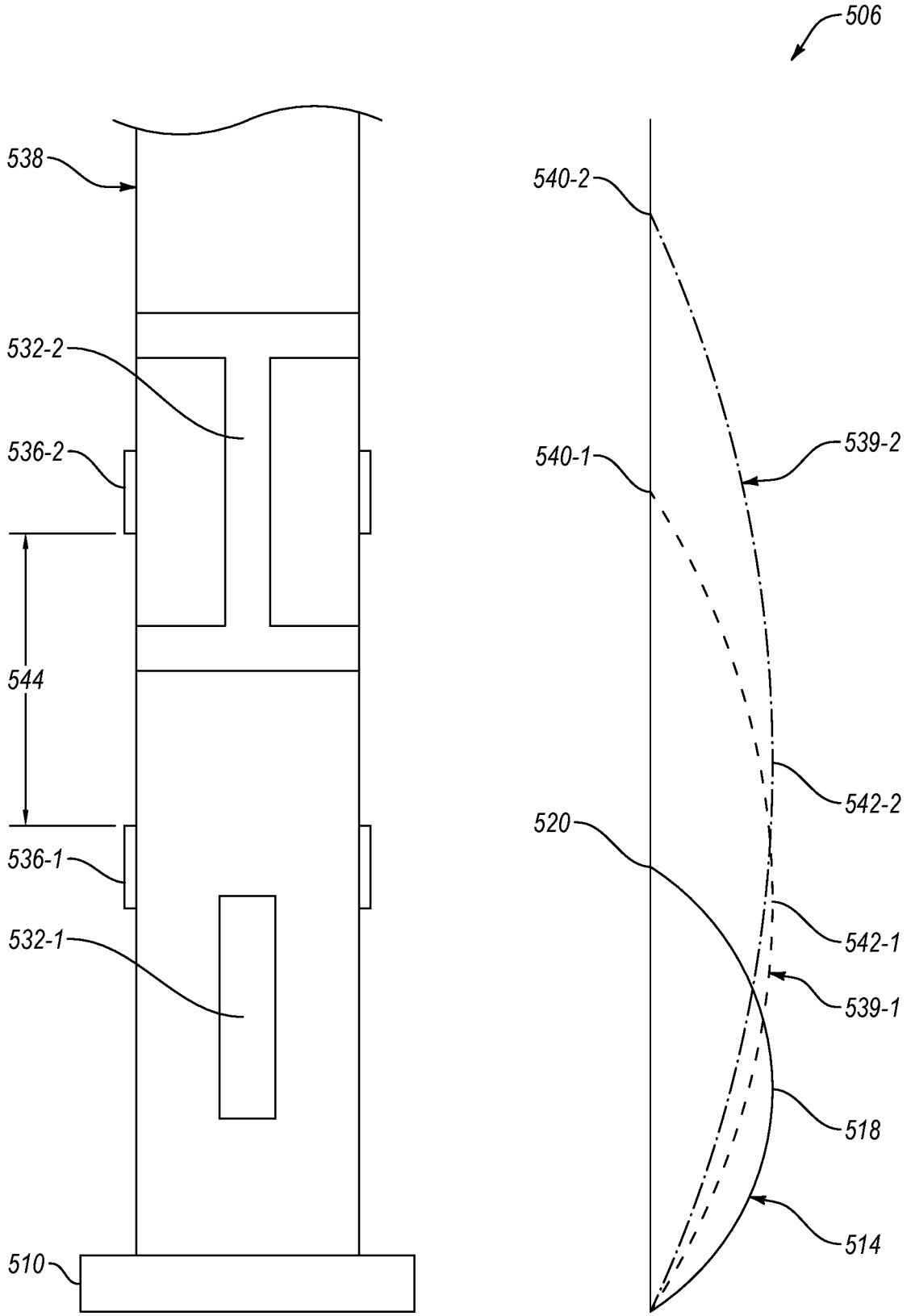
FIG. 5 is a schematic representation of a bottomhole assembly, according to at least one embodiment of the present disclosure.

FIG. 5 is a representation of a schematic BHA 506 including one or more HFTO mitigation mechanisms (collectively 536), according to at least one embodiment of the present disclosure. The BHA 506 includes a bit 510, a first downhole tool 532-1 uphole of the bit 510, and a second downhole tool 532-2 uphole of the first downhole tool 532-1. In some embodiments, the first downhole tool 532-1 and the second downhole tool 532-2 may include any downhole tool, such as an RSS, an axially or radially expanding tool, a flex joint, an MWD, and LWD, a reamer, a casing cutter, a stabilizer, a data logger, any other downhole tool, and combinations thereof.

Modeling and/or post-drilling analysis of the BHA 506 drilling a dogleg may identify an unmitigated HFTO waveform 514. The unmitigated HFTO waveform 514 may be the waveform of the Type 2 HFTO for the BHA 506. The unmitigated HFTO waveform 514 may have an unmitigated oscillation node 520. The unmitigated oscillation node 520 may be the location (e.g., λ/2) of the oscillation node along the length of the BHA 506 without any mitigation mechanism in place, with an extended location of contact at the oscillation node 520. As may be seen, the location of the unmitigated oscillation node 520 may be at the first downhole tool 532-1, but may also be downhole of, uphole of, or at the uphole end of the first downhole tool 532-1. When located at or near the first downhole tool 532-1, the unmitigated HFTO waveform 514 may result in damage to the first downhole tool 532-1.

In accordance with embodiments of the present disclosure, a first HFTO mitigation mechanism 536-1 may be installed on the BHA 506 at the unmitigated oscillation node 520. The HFTO mitigation mechanism 536 may alter the contact of an outer surface 538 of the BHA 506 with the wellbore wall. Altering the contact of the outer surface 538 of the BHA 506 with the wellbore wall may reduce the contact length of the outer surface 538 of the BHA 506 with the wellbore wall. As discussed herein, an oscillation node may be formed at a contact between the BHA 506 and the wellbore if that contact has sufficient length and/or friction. By altering the contact of the wellbore wall (e.g., contact length, amount of friction, etc.) the unmitigated oscillation node 520 may be stopped from acting as an oscillation mode, and the oscillation node may be moved uphole of the first downhole tool 532-1. This may help to relieve the torsional strain and strain cycling placed on the first downhole tool 532-1.

In some embodiments, the first HFTO mitigation mechanism 536-1 may modify the unmitigated HFTO waveform 514 to a modified HFTO waveform (collectively 539). The modified HFTO waveform 539 may have a mitigated oscillation node (collectively 540). Thus, in some embodiments, the first HFTO mitigation mechanism 536-1 may modify the unmitigated oscillation node 520 to a mitigated oscillation node 540. The drilling operator may identify the location of the mitigated oscillation node 540 with respect to any other downhole tools, such as the second downhole tool 532-2.

In the embodiment shown, the first HFTO mitigation mechanism 536-1 may modify the unmitigated HFTO waveform 514 to the first modified HFTO waveform 539-1. This may cause the unmitigated oscillation node 520 to be moved uphole of the HFTO mitigation mechanism 536 to a first mitigated oscillation node 540-1. Using the first modified HFTO waveform 539-1, the drilling operator may identify that the first mitigated oscillation node 540-1 is located at the second downhole tool 532-2. As discussed herein, this may result in damage to the second downhole tool 532-2.

The drilling operator may then utilize a second HFTO mitigation mechanism 536-2 to further modify the first modified waveform 539-1 to a second modified waveform 539-2. For instance, the second HFTO mitigation mechanism 536-2 may change the length of contact or friction at a location corresponding to the node 540-1, thereby decreasing the ability of the location to act as an oscillation node. Using the second modified waveform 539-2, the drilling operator may then identify a second mitigated oscillation node 540-2. The second mitigated oscillation node 540-2 may be located above or uphole of the second downhole tool 532-2.

In some embodiments, the mitigated oscillation node 540 may be moved to a location above the second downhole tool 532-2 by utilizing one or more HFTO mitigation mechanisms. In some embodiments, the mitigated oscillation node 540 may be located above a particular downhole tool. For example, the mitigated oscillation node 540 may be located above an MWD, an LWD, an RSS, a flexible joint, an axially or radially expanding tool, any other downhole tool, and combinations thereof. As discussed herein, this may help to reduce or prevent damage to the first downhole tool 532-1 and/or the second downhole tool 532-2 resulting from HFTO. In some embodiments, the mitigated oscillation node 540 may be located above the BHA 506. This may transfer the maximum torsional strain to the drill string. The drill string may not include structures, points, electronics, or other elements that may have features that lead to stress concentrations or which otherwise have an increased susceptibility to damage. This may help to reduce or prevent damage to the downhole tool, resulting in faster overall penetration rates and fewer lost wellbores.

In some embodiments, modifying the HFTO waveform 514 may cause a change in a peak 518 displacement during vibration. For example, the first modified HFTO waveform 539-1 may have a first modified peak 542-1 displacement and the second HFTO waveform 539-2 may have second modified peak 542-2 displacement. In some embodiments, the drilling operator may adjust the HFTO waveform 514 so that the modified peak (collectively 542) displacement is located at a particular location. For example, the drilling operator may adjust the HFTO waveform 514 so that the modified peak 542 displacement is located above or uphole of the first downhole tool 532-1 or the second downhole tool 532-2. In some embodiments, the drilling operator may adjust the HFTO waveform 514 so that the modified peak 542 displacement is located above a particular downhole tool, such as an MWD, an LWD, an RSS, a flexible joint, an axially or radially expanding tool, any other downhole tool, and combinations thereof. This may allow the drilling operator to move the modified peak 542 displacement to any suitable location.

In some embodiments, the BHA 506 and/or downhole drilling system may include both an HFTO mitigation mechanism 536 and an energy damping system. The HFTO mitigation mechanism 536 may be used to move the location of any oscillation nodes, and the energy damping system may be used to absorb or reduce the magnitude of the oscillations. In some embodiments, the drilling operator may adjust the HFTO waveform 514 so that the modified peak 542 is located at a location of the energy damping system. Put another way, the drilling operator may locate one or more HFO mitigation mechanism 536 (which optionally include contact point features to move nodes, energy damping systems, or combinations thereof) to reduce or prevent the negative effects of HFO and other vibrations. In some embodiments, one or more HFO mitigation mechanisms 536 may be located on an energy damping system.

In accordance with embodiments of the present disclosure, the HFTO mitigation mechanism 536 may include any type of HFTO mitigation mechanism. For example, the HFTO mitigation mechanism 536 may include an element that is radially offset from the outer surface 538 of the BHA 506, and thus maintains an offset between the outer surface 538 and the wellbore wall. The length or other configuration of the mitigation mechanism 536 may reduce the amount of friction at that location relative to the location without the mitigation mechanism 536, which may reduce the contact length of the outer surface 538 with the wellbore wall. Reducing the contact length or friction of the outer surface 538 with the wellbore wall may help to reduce or prevent the formation of an oscillation node. In some embodiments, the HFTO mitigation mechanism 536 may include a stabilizer (fixed or rotating), a wear sleeve, a rotating wear sleeve, one or more rollers, any other HFTO mitigation mechanism 536, and combinations thereof. In some embodiments, a rotating wear sleeve may include one or more surfaces that rotate relative to the outer surface of the downhole tool. In some embodiments, the rotating wear sleeve includes a rotating stabilizer. In some embodiments, the HFTO mitigation mechanism 536 may include a combination of both an energy damping system which may damp or reduce the amplitude of oscillations and a contact element that may reduce the surface contact of the downhole tool. This may help to increase the effectiveness of the energy damping system by preventing a node from forming at the energy damping system. In some embodiments, a contact element may be located in or near the middle of a long flex joint. This may help to prevent the flex joint from forming an oscillation node. In some embodiments, the contact element may have a large diameter section to reach from the flex joint to the wellbore wall.

As may be seen in FIG. 5, a BHA 506 may include HFTO mitigation mechanism 536. For example, the first HFTO mitigation mechanism 536-1 may offset the outer surface 538 of the BHA 506 from the wellbore wall. The outer surface 538 may then engage the wall over a prolonged distance at a location that is some distance uphole from the first HFTO mitigation mechanism 536-1. This may result in the first mitigated oscillation node 540-1. The drilling operator may then install a second HFTO mitigation mechanism 536-2 on the BHA 506. Contact of the outer surface 538 with the wellbore wall may then be moved further uphole, above the second downhole tool 532-2, resulting in the second mitigated oscillation node 540-2.

In some embodiments, the first HFTO mitigation mechanism 536-1 may be separated from the second HFTO mitigation mechanism 536-2 with a separation distance 544. In some embodiments, the separation distance 544 may be in a range having an upper value, a lower value, or upper and lower values including any of 6 ft. (1.8 m), 8 ft. (2.4 m), 10 ft. (3.0 m), 12 ft. (3.7 m), 14 ft. (4.3 m), 16 ft. (4.9 m), 18 ft. (5.5 m), 20 ft. (6.1 m), 50 ft. (15.2 m), or any value therebetween. For example, the separation distance 544 may be greater than 6 ft. (1.8 m). In another example, the separation distance 544 may be less than 20 ft. (6.1 m) or less than 50 ft. (15.2 m). In yet other examples, the separation distance 544 may be any value in a range between 6 ft. (1.8 m) and 20 ft. (6.1 m). In some embodiments, the separation distance 544 may be greater than 20 ft. (6.1 m) or greater than 50 ft. (15.2 m). In some embodiments, it may be critical that the separation distance 544 is greater than 10 ft. (3.0 m) to reduce the ability of the two HFTO mitigation mechanisms 536 to collectively act as an oscillation node. For example, if two HFTO mitigation mechanisms 536 are too close together, they may act as a single extended contact with the wellbore wall, resulting in the formation of an oscillation node. Separating the two HFTO mitigation mechanisms 536 with the separation distance 544 may reduce or prevent the formation of an oscillation node with both HFTO mitigation mechanism 536.

Figure 6:
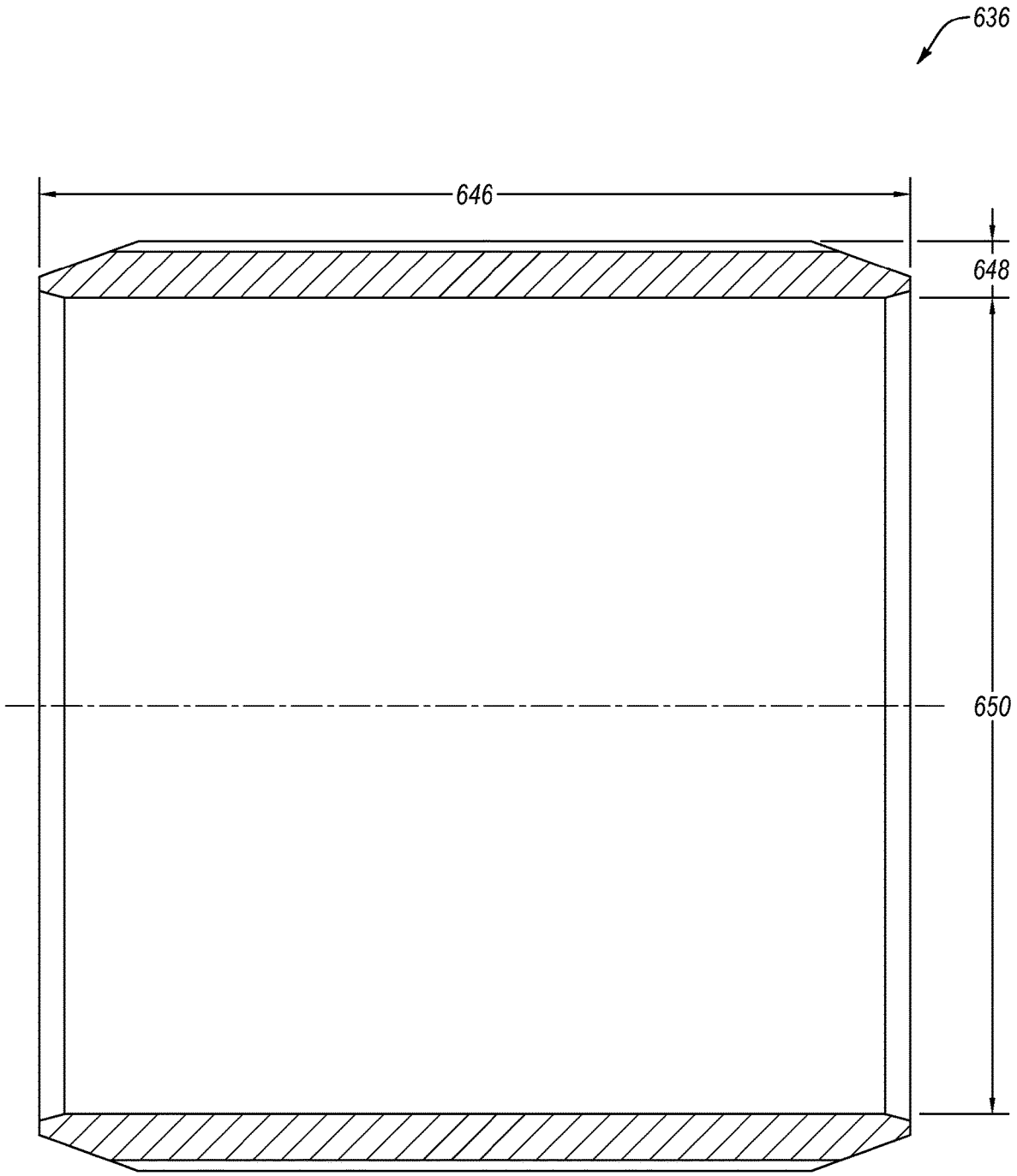
FIG. 6 is a cross-sectional view of an HFTO mitigation mechanism, according to at least one embodiment of the present disclosure.

FIG. 6 is a representation of an HFTO mitigation mechanism 636 according to at least one embodiment of the present disclosure. The HFTO mitigation mechanism 636 shown is a sleeve or wear band. The sleeve may be configured to be installed around the outer surface of a downhole drilling tool. The sleeve may be a compression ring, which is designed or configured to connect to the downhole drilling tool with a compressive force. In some embodiments, the sleeve may be connected to the downhole drilling tool using any other mechanism, such as a mechanical fastener, welding, brazing, any other connection mechanism, and combinations thereof. Attachment mechanisms may fix rotation of the HFTO mitigation mechanism 636 to rotation of the BHA, or may allow the HFTO mitigation mechanism 636 to rotate relative to the BHA.

In some embodiments, the HFTO mitigation mechanism 636 may be formed from or include a wear resistant material. In some embodiments, the HFTO mitigation mechanism 636 may be formed from or include a hard material such as tungsten carbide or polycrystalline diamond. In some embodiments, the HFTO mitigation mechanism 636 may include a hard coating. In some embodiments, the HFTO mitigation mechanism 636 may be formed from or include an ultrahard material. As used herein, the term "ultrahard" is understood to refer to those materials known in the art to have a grain hardness of about 1,500 HV (Vickers hardness in kg/mm2) or greater. Such ultrahard materials can include but are not limited to diamond, sapphire, moissantite, hexagonal diamond (Lonsdaleite), cubic boron nitride (cBN), polycrystalline cBN (PcBN), Q-carbon, binderless PcBN, diamond-like carbon, boron suboxide, aluminum manganese boride, metal borides, boron carbon nitride, PCD (including, e.g., leached metal catalyst PCD, non-metal catalyst PCD, and binderless PCD or nanopolycrystalline diamond (NPD)) and other materials in the boron-nitrogen-carbon-oxygen system which have shown hardness values above 1,500 HV, as well as combinations of the above materials. In some embodiments, the ultrahard material may have a hardness value above 3,000 HV. In other embodiments, the ultrahard material may have a hardness value above 4,000 HV. In yet other embodiments, the ultrahard material may have a hardness value greater than 80 HRa (Rockwell hardness A).

The dimensions of the HFTO mitigation mechanism 636 may be critical to reduce or prevent the formation of an oscillation node. For example, as discussed herein, the HFTO mitigation mechanism 636 may help to offset the outer surface of the downhole tool from the wellbore wall, but without forming an oscillation node itself. In some embodiments, the HFTO mitigation mechanism 636 has a mechanism length 646. A mechanism length 646 that is too short may not fully or effectively offset the downhole tool from the wellbore wall. A mechanism length 646 that is too long may generate an oscillation node. In some embodiments, the mechanism length 646 may be in a range having an upper value, a lower value, or upper and lower values including any of 6 in. (15 cm), 8 in. (20 cm), 10 in. (25 cm), 12 in. (30 cm), 15 in. (38 cm), or any value therebetween. For example, the mechanism length 646 may be greater than 6 in. (15 cm). In another example, the mechanism length 646 may be less than 12 in. (30 cm) or less than 15 in. (38 cm). In yet other examples, the mechanism length 646 may be any value in a range between 6 in. (15 cm) and 12 in. (30 cm). In some embodiments, it may be critical that the mechanism length 646 is less than 15 in. (38 cm) or even less than 12 in. (30 cm) to effectively move the location of the oscillation node.

The HFTO mitigation mechanism 636 includes a mechanism thickness 648. The thickness 648 may represent a radial distance between the outer surface of the HFTO mitigation mechanism 636 and the outer diameter of the BHA at the installation location. If the mechanism thickness 648 is too small, then it may not sufficiently offset the downhole tool from the wellbore wall to move the oscillation node. If the mechanism thickness 648 is too large, then drilling fluid may not be able to pass between the HFTO mitigation mechanism 636 and the wellbore wall. In some embodiments, the mechanism thickness 648 may be in a range having an upper value, a lower value, or upper and lower values including any of 0.05 in. (1.3 mm), 0.1 in. (2.5 mm), 0.15 in. (3.8 mm), 0.2 in. (5.1 mm), 0.25 in. (6.4 mm), 0.3 in. (7.6 mm), 0.4 in. (1.0 cm), or any value therebetween. For example, the mechanism thickness 648 may be greater than 0.05 in. (1.3 mm). In another example, the mechanism thickness 648 may be less than 0.4 in. (1.0 cm). In yet other examples, the mechanism thickness 648 may be any value in a range between 0.05 in. (1.3 mm) and 0.4 in. (1.0 cm). In some embodiments, it may be critical that the mechanism thickness 648 is between 0.05 in. (1.3 mm) and 0.4 in. (1.0 cm) to prevent the formation of an oscillation node.

The HFTO mitigation mechanism 636 has an inner diameter 650. The inner diameter 650 may be sided to fit around the outer surface of the downhole tool. This may allow the HFTO mitigation mechanism 636 to be connected to or attached to the downhole tool. In some embodiments, the inner diameter 650 may be the same as, slightly larger, or slightly smaller than the outer diameter of the downhole tool. In still other embodiments, the mechanism thickness 648 may be greater than 0.4 in. (1.0 cm). For instance, in larger diameter wells or with larger diameter tools, the mechanism thickness 648 may be greater. Thus, a ratio of the thickness 648 to the inner diameter 650 (or tool diameter) may be critical. By way of example, the ratio of the thickness to the inner diameter 650 (or tool diameter) may be between 0.002 to 0.1. In another example, the ratio of the thickness to the inner diameter 650 (or tool diameter) is between 0.004 and 0.07.

Figures 1, 7:
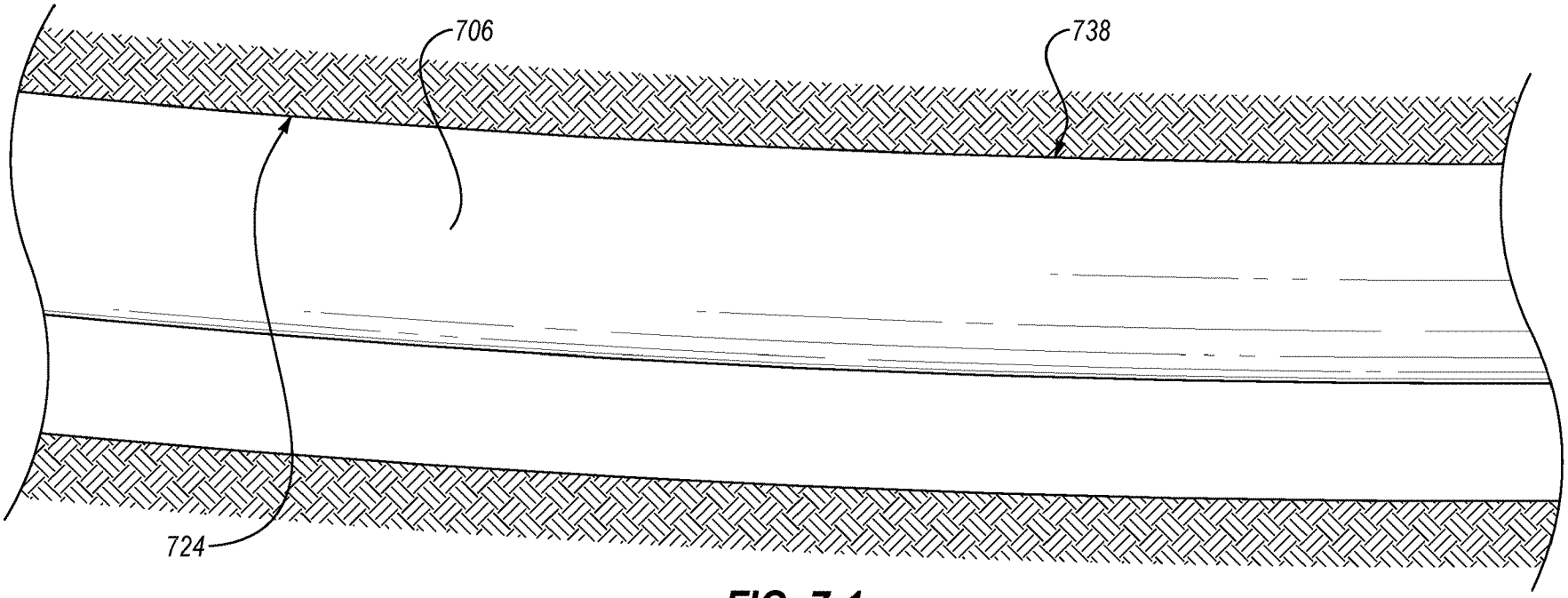
Figures 2, 7:
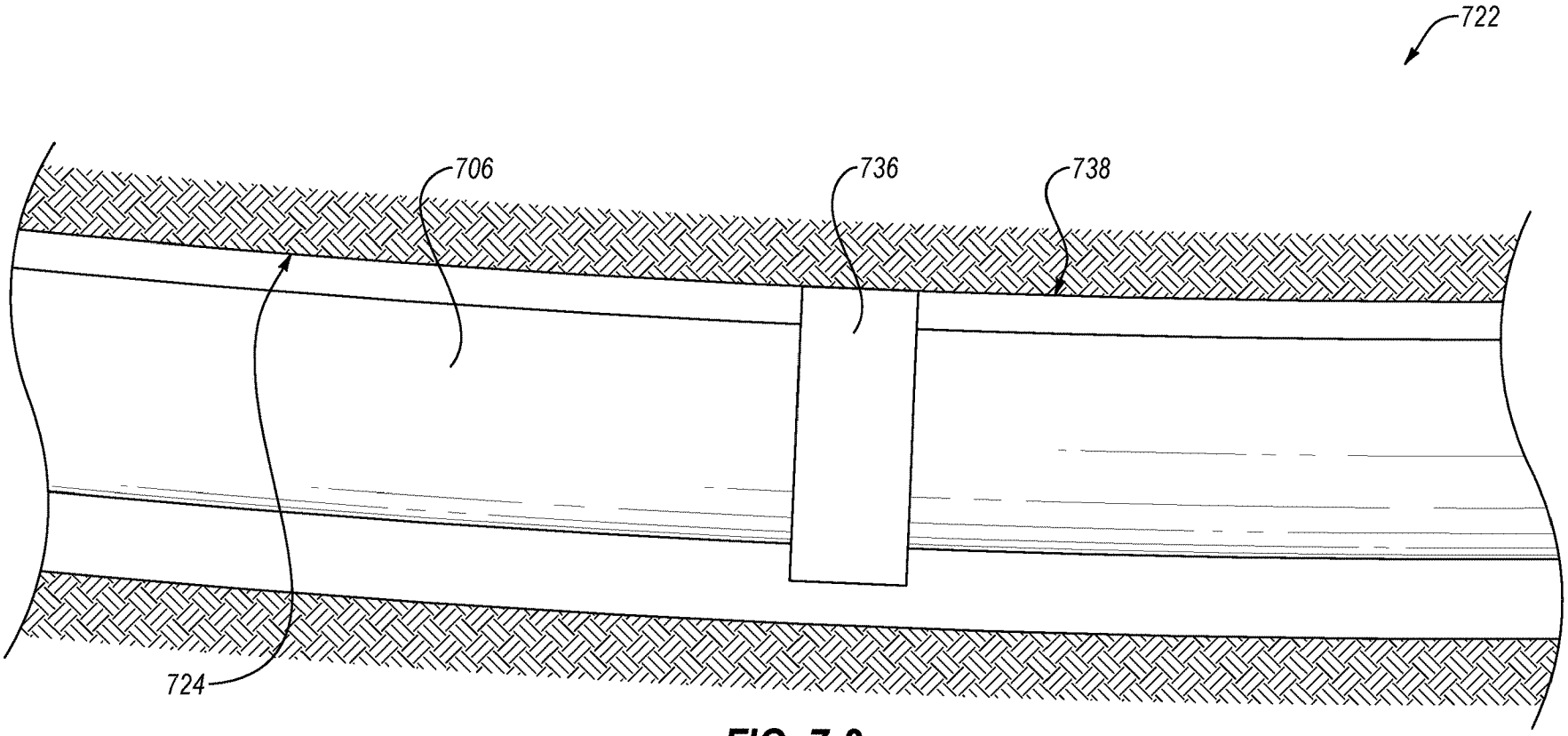

FIG. 7-1 and FIG. 7-2 are representations of a section of BHA 706 in a wellbore dogleg 722, according to at least one embodiment of the present disclosure. In the embodiment shown, an outer surface 738 of the BHA 706 is in contact with the wellbore wall 724 of the dogleg 722 over an extended contact region or contact length. As discussed herein, this may result in an oscillation node being formed at the contact region. To mitigate and/or move the oscillation node, an HFTO mitigation mechanism 736 may be installed on the BHA 706, as may be seen in FIG. 7-2.

In FIG. 7-2 the HFTO mitigation mechanism 736 has offset the BHA 706 from the wellbore wall 724. As may be seen, the outer surface 738 of the BHA 706 adjacent the HFTO mitigation mechanism 736 is not in contact with the wellbore wall 724. In some embodiments, the contact length of the BHA 706 against the wellbore wall 724 may be the mechanism length 646 shown in FIG. 6. The mechanism length may be significantly less than the contact length of the BHA 706. This may reduce or prevent the formation of an oscillation node at the BHA 706, or the region of the BHA adjacent the HFTO mitigation mechanism 736. In the same or other embodiments, the formation of an oscillation node may be impeded in other manners, such as by installing a friction reducing component (e.g., roller, rotating wear sleeve or stabilizer, anti-friction coating), etc. Such mechanisms may or may not have a reduced length relative to the contact length of the BHA 706 Any of these mechanisms may help to reduce friction or the formation of an oscillation node, and thus move the oscillation node to reduce drilling costs related to damage caused by HFTO at or near the contact location.

Figure 8:
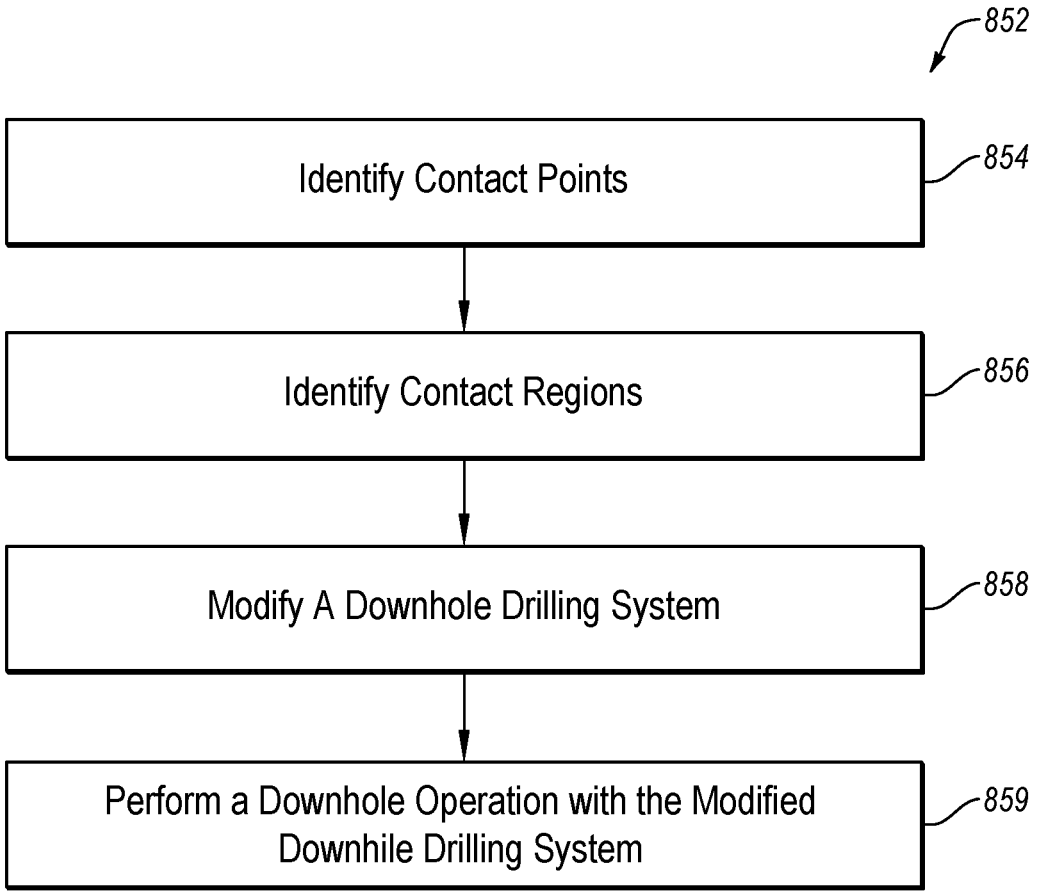
FIG. 8 is a flowchart of a method for mitigating torsional oscillation, according to at least one embodiment of the present disclosure.

FIG. 8 is a flowchart of a method 852 for mitigating HFTO, according to at least one embodiment of the present disclosure. The method 852 may include identifying one or more contact points associated with HFTO in a downhole drilling system at 854. In some embodiments, identifying contact points includes modeling bending associated with torsional oscillation or HFTO of a downhole drilling system at 854. Modeling bending of the downhole drilling system may include modeling the vibration and oscillation properties of a downhole drilling system, and can consider the system configuration as well as operating and formation parameters. The model may identify the presence of HFTO in the downhole drilling system. In some embodiments, the model may identify the types of HFTO that may be present in the downhole drilling system. For example, the model may identify the presence of Type 1 HFTO, Type 2 HFTO, and any other types of HFTO.

In some embodiments, a bending or drilling model may be any type of model. For example, modeling the bending may include performing a dynamic drilling simulation as a transient time simulation based on time or incremental rotation of the downhole drilling system. For example, the dynamic drilling simulation may include those disclosed in U.S. Pat. Nos. 6,516,293, 6,785,641, 6,873,947, 7,020,597, 7,139,689, 7,260,514, 7,464,013, 7,693,695, 7,844,426, 7,899,658, 8,401,831, 8,812,281, and 9,482,055, as well as U.S. Patent Publication Nos. 2004/0143427, 2007/0067147, and 2017/0030166, all of which are incorporated by reference in their entirety.

In some embodiments, modeling the bending system includes considering at least one of weight on the downhole system (e.g., weight on bit (WOB)), the curvature of the wellbore (e.g., dogleg radius, radius of curvature), the downhole tool configuration, the downhole fluid composition, the downhole formation, and combinations thereof. Each of these elements may have an effect on the type or properties of HFTO.

In some embodiments, identifying the one or more contact points at 854 may be performed without a model. For instance, a BHA may return from a run and sensor data or tool damage may indicate a location of one or more nodes. Thus, tools from offset wells or other similar wells may be used to identify the location of a contact point. In other examples, an experienced operator may use experience to identify one or more likely contact points.

In some embodiments, the method 852 may include identifying one or more contact regions of the downhole drilling system that are associated with HFTO at 856. In some embodiments, identifying the one or more contact regions of the downhole drilling system may include identifying one or more oscillation nodes of an oscillation waveform. This may be used to determine where a high likelihood of damage due to torsional strain from Type 2 HFTO may be located. The location of contact regions may be based on the one or more contact points identified at 854. For instance, a pair of contact points may be identified at 854 (e.g., at a bit and a location above the bit, at an underreamer or casing cutter and a location above or below the underreamer/casing cutter, etc.). The pair of contact points may be adjacent contact points and the contact regions identified at 856 may be located at the contact points.

After identifying the contact regions and/or the oscillation nodes, a drilling model and/or a drilling operator may modify a downhole drilling system at 858. Modifications can occur at one or more contact regions (e.g., to move a node) and/or between nodes (e.g., to add an energy damping element). This modification may be used to modify properties of an HFO waveform at the identified location. For instance, an identified oscillation node can be eliminated/moved such that the next oscillation node of a pair of nodes is moved uphole or toward a surface of the wellbore, or otherwise away from a component sensitive to HFTO damage. In some embodiments, modifying the downhole drilling system may include adding an HFTO mitigation mechanism to the downhole drilling system. Moving the contact point may change the period, frequency, amplitude, or other properties of the waveform.

In some embodiments, the method 852 includes drilling or performing another downhole operation with the modified drilling system at 859. In some embodiments, performing the drilling operation at 859 therefore can include constructing the modified downhole drilling system. In some embodiments, the oscillation node may be moved to a location above or away from one or more downhole tools, such as the RSS, an MWD, an LWD, a data logger, any other downhole tool, and so forth.

In some embodiments, the results of a model and/or the modified downhole drilling system may be presented to a user, such as a drilling operator. For example, the results of the model may be displayed on a display. The user may interact with the display to visualize the HFTO waveform, visualize the location of the oscillation nodes, modify the downhole drilling system, add HFTO mitigation mechanisms, and so forth. This may help a drilling operator to prepare or modify a design of the downhole drilling system to mitigate the effects of HFTO.

Figure 9:
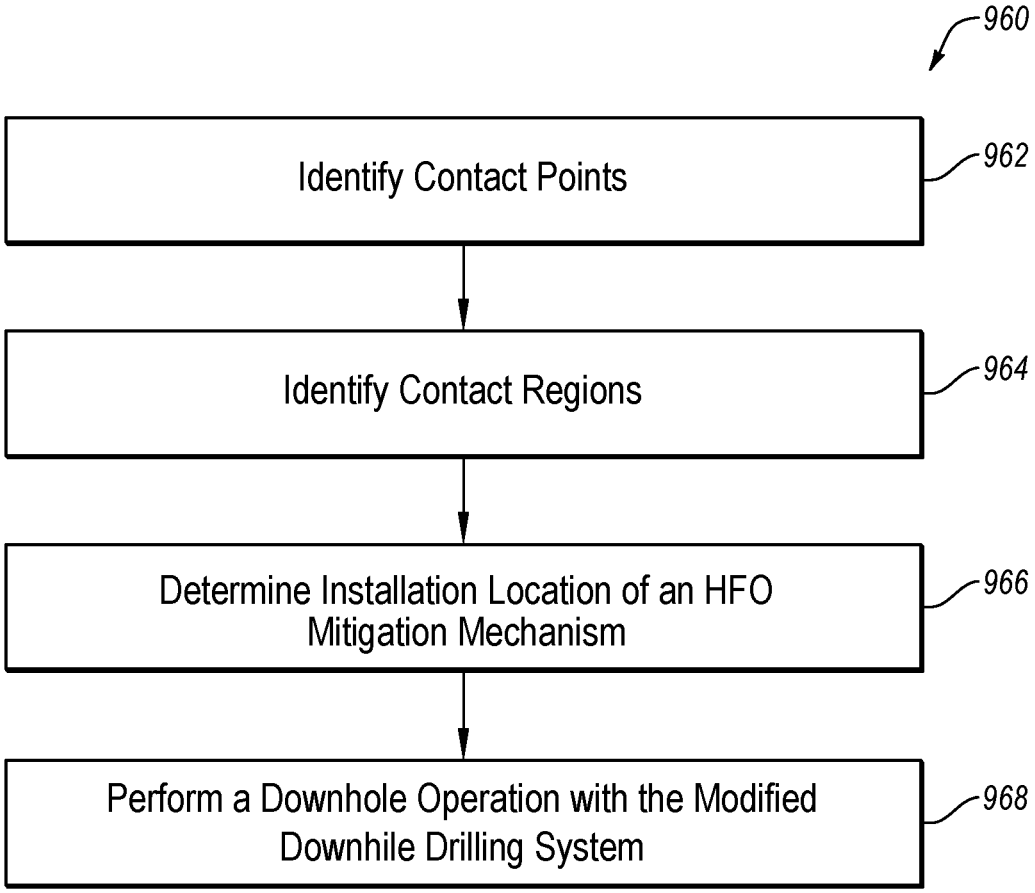
FIG. 9 is a flowchart of a method for mitigating torsional oscillation, according to at least one embodiment of the present disclosure.

FIG. 9 is a flowchart of a method 960 for mitigating damage due to HFTO, according to at least one embodiment of the present disclosure. The method 960 may include identifying contact points at 962. As discussed with respect to FIG. 8, such identification can include modeling bending of a downhole drilling system, using knowledge from prior tools, or the like. Where modeling is used, modeling bending of the downhole drilling system may include modeling the vibration and oscillation properties of a downhole drilling system along a wellbore trajectory.

In some embodiments, the method 960 may include identifying one or more contact regions of the downhole drilling system with a wellbore wall at 964. In some embodiments, the one or more contact regions may be associated with an oscillation node of the downhole drilling system. In some embodiments, the one or more contact regions may be located at a BHA on the downhole drilling system.

After the contact regions are identified and based on the identified contact regions, an installation location of an HFTO mitigation mechanism may be determined at 966. The HFTO mitigation mechanism may modify a vibration profile (e.g., modify the HFTO waveform or node locations) of the downhole drilling system. In some embodiments, the method may further include installing the HFTO mitigation mechanism on an outer surface of the downhole drilling system at the installation location. In some embodiments, the HFTO mitigation mechanism may be installed on the outer surface of the BHA. In some embodiments, installing the HFTO mitigation mechanism may reduce the identified one or more contact lengths of contact points/regions of the downhole drilling system, or otherwise reduce friction at the location to eliminate the operation of the contact point as an oscillation node. Such a reduction may cause the oscillation node to move uphole or away from a sensitive component. An energy damping system may be located away from a node to absorb energy at high displacement locations. When the installation location is determined, the HFTO mitigation mechanism can be installed and the modified drilling system used at 968 to perform a downhole operation.

As discussed herein, HFTO is a particular category of oscillations that can occur within drilling tools and which can have a destructive impact. HFTO may be found in a frequency range of 60 to 350 Hz (along with harmonics) and can be primarily torsional; however, recent measurements within the scope of the present disclosure have shown that there is often a strong axial component accompanying HFTO. For instance, axial oscillations can be seen with frequencies up to 1200 Hz. In some cases, the axial component can even be dominant over the torsional oscillations. This behavior can be observed with a definitive correlation to acoustic noise in the mud system. Accordingly, HFO can be both torsional and axial in some embodiments. For certain embodiments discussed herein, two forms of HFO are discussed including Type 2 HFO that often exists below a motor (or the lower end of an RSS assembly) and which enters torsional resonance even when the HFO is primarily axial. Type 1 HFO can also be considered where there is a motor (e.g., where the pressure perturbations drive oscillations through the steering pads and lateral cutters of a push-the-bit RSS tool). The Type 1 HFO can sometimes be observed at a frequency around 300 Hz and at its corresponding harmonics.

To address the detrimental effects of HFO, HFTO/HFO mitigation mechanisms can be introduced on the BHA. Additionally, or alternatively, torsional dampers may be included in the BHA. Such dampers can be effective for certain HFO, but may not be completely effective for all HFO/HFTO (e.g., axial HFO or HFO from acoustic noise in the mud system) and tools. To further mitigate effects of HFO (or to reduce the occurrences of HFO), some embodiments of the present disclosure contemplate other measures in addition to, or instead of, torsional dampers. For instance, acoustic dampers or axial dampers can be used to attenuate the drivers of the HFO, including within the mud system used by a downhole motor.

Figure 10:
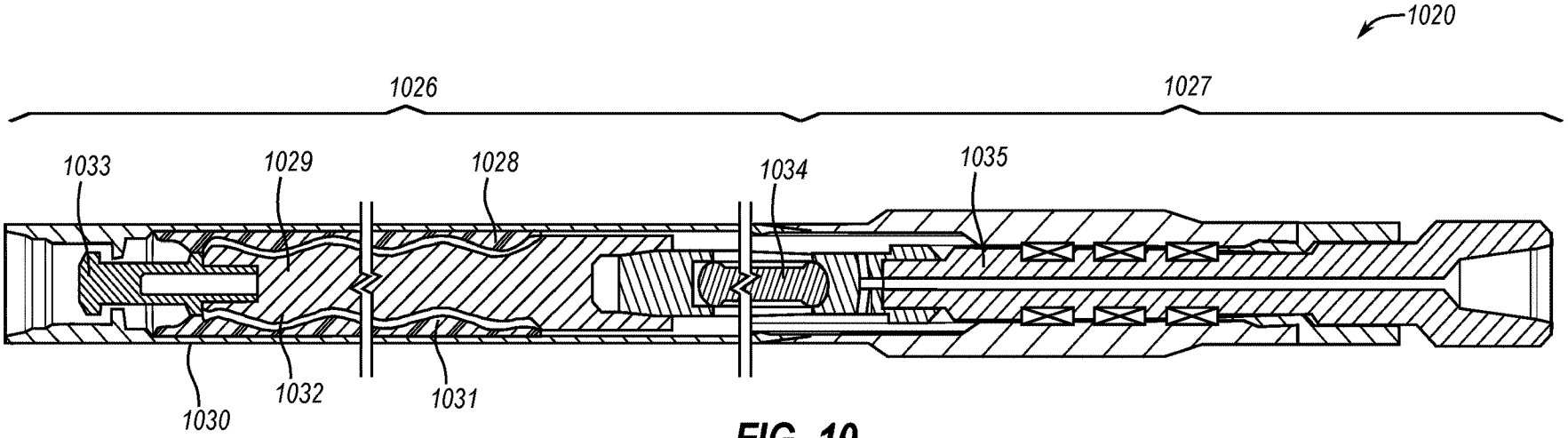
FIG. 10 is a cross-sectional view of a downhole motor, according to one or more embodiments of the present disclosure.

To illustrate some examples of how embodiments of the present disclosure can be implemented, FIG. 10 illustrates an example downhole motor 1020. The downhole motor 1020 can be used as the directional module 111 of FIG. 1, or included in another module in the BHA 106. The illustrated downhole motor 1020 may be referred to as a drilling motor, mud motor, or positive displacement motor, and includes a power section 1026 and a bearing section 1027. The power section 1026 includes a stator 1028, and a rotor 1029 that is located within, and is rotatable relative to, the stator 1028. The stator 1028 includes a housing 1030 and a plurality of lobes 1031 within the housing 1030. In some embodiments, the lobes 1031 are formed of a metal or metal alloy, and are optionally integral with the housing 1030. In other embodiments, the lobes 1031 are formed of or coated with an elastomer. The rotor 1029 may also be formed of a suitable material, such as a metal, metal alloy, composite, or other material. The rotor 1029 also includes a plurality of lobes 1032. The number of rotor lobes 1032 may be different than the number of stator lobes 1031. For instance, the stator 1028 may have one more lobe 1031 as compared to the number of lobes 1032 of the rotor 1029.

In operation, drilling fluid may flow into the housing 1030, and between a gap between the rotor lobes 1032 and the stator lobes 1031. The rotor lobes 1032 and stator lobes 1031 are helically or spirally oriented and can seal at discrete intervals to create fluid champers, as a result, and their helical angles are configured such that the rotor lobes 1032 and the stator lobes 1031 form a seal at one or more locations to define fluid chambers. Drilling fluid between the rotor 1029 and stator 1028 then flows through the cavities and causes the rotor 1029 to rotate inside the stator 1028. Due to the geometry and configuration of the rotor 1029 and stator 1028, the rotor moves in a planetary manner around the interior of the stator 1028, with the geometry, design, and configuration (e.g., number of lobes 1031, 1032) defining the performance and output of the downhole motor 1020.

In one some embodiments, the rotor 1029 is coupled one end (e.g., an uphole end) to a rotor catcher 1033. The rotor catcher 1033 may be threaded or otherwise coupled to the rotor 1029, and used to limit or even prevent the loss of motor components during operation of the downhole motor 1020. The rotor catcher 1033 may be inside a collar coupled to the motor 1020, or may be inside the housing 1030 which can act as a collar. In the same or other embodiments, the rotor 1029 is coupled to a flexible shaft 1034 that is directly or indirectly coupled to a drive shaft 1035. In operation, the drilling fluid pumped into the housing 1030 rotates the rotor 1029, which causes the flexible shaft 1034 to also rotate. The flexible shaft 1034 then rotates the drive shaft 1035. A drill bit (e.g., drill bit 110 of FIG. 1) can be coupled to the bottom end of the drive shaft 1035 or bearing assembly 1027, and thus can be rotated as the drive shaft 1035 rotates.

The downhole motor 1020 is illustrative of a fluid driven motor, but in other embodiments other types of motors or drive mechanisms may be used. For instance, in relation to FIG. 1, a rotary drilling system may rotate a BHA using surface rotary equipment, and thus drive rotation of the drill bit. Electromechanical motors may also be used for driving a drill bit from a downhole source. Other downhole motors may also be included in directional drilling tools or other components. For instance, an electromechanical or hydraulic motor may be used in a rotary steerable system as part of a control unit to control a position of one or more valves and to provide power to electronics that determine the proper position of one or more valves. In other rotary steerable systems, an electromechanical or hydraulic motor may be used to control an orientation of a shaft (e.g., a point-the-bit system).

Consistent with some embodiments disclosed herein, a downhole motor (of which the motor 1020 of FIG. 10 is but one example), may be strategically designed to achieve a desired mitigation effect on one or more types of HFO within the motor. This may occur by, for instance, including one or more HFO mitigation components. Geometric sizing, material selection, placement in the tool, and the physical construction may be selected and varied to enable the motor to achieve certain capabilities or mitigate potential oscillations. Such oscillations may be observed (e.g., in offset wells), simulated, or otherwise expected. Such a design may also be used in combination with other mitigation techniques, including the methods described herein (see, e.g., FIGS. 8 and 9).

Figure 11:
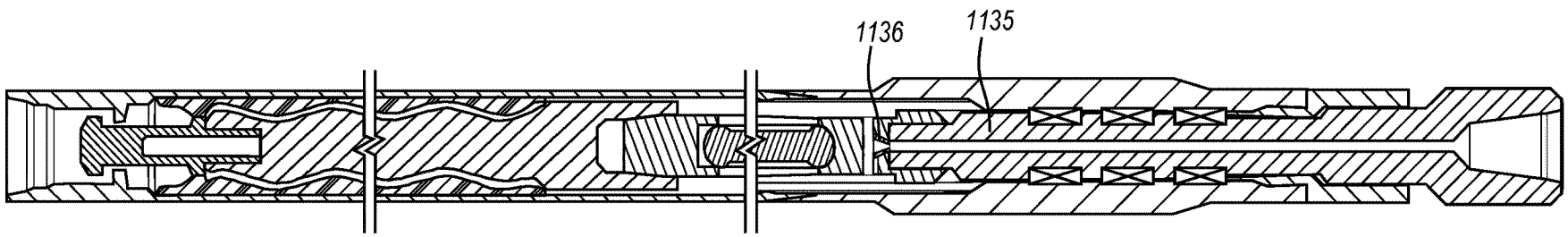
FIG. 11 is a cross-sectional view of an additional downhole motor, according to one or more embodiments of the present disclosure.

FIG. 11 illustrates one type of an example motor 1120 that has been selected to mitigate certain oscillations expected in a downhole drilling environment. The mud motor 1120 is shown to be similar to the motor 1020 of FIG. 10 to illustrate example components that can be used for oscillation mitigation. For simplicity, similar components will not be described, but the motor 1120 can include any or all of the various components described with respect to FIG. 10.

In this particular embodiment, the mud motor 1120 includes a drive shaft 1135 within a bearing section coupled to a power section. Fluid/mud flows through the power section to rotate the rotor, which in turn rotates the drive shaft 1135. Fluid that flows through the power section can flow into the drive shaft 1135, and down to a drilling tool such as a drill bit.

The drive shaft 1135 may be fitted with a flow restrictor 1136, which restricts flow as it enters the drive shaft 1135. In FIG. 11, the flow restrictor 1136 is shown as a simple nozzle, and operates to change the fluid properties (e.g., speed up the flow and reduce pressure). The nozzle or other flow restrictor 1136 can change the flow properties and thereby mitigate HFO. In some embodiments, the flow restrictor 1136 is placed close to the rotor/stator (e.g., where the flow enter the drive shaft 1135). Placing the flow restrictor 1136 close the to the rotor/stator can mitigate a number of frequencies of oscillations. In addition, in some embodiments, the flow restrictor 1136 is flow rate or pressure dependent. A variable flow restrictor 1136 may be used to attenuate pressure perturbations, and thereby reduce HFO.

Figure 12:
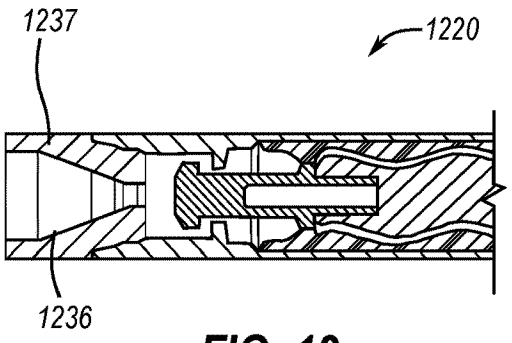
FIG. 12 is a partial cross-sectional view of an additional downhole motor, according to one or more embodiments of the present disclosure.

In other embodiments, a flow restrictor 1136 may be positioned in additional or other locations. FIG. 12, for instance, shows a portion of a power section of a motor 1220, where a housing of the power section is coupled to a collar 1237. The collar 1237 defines or includes a flow restrictor 1236. For simplicity, the flow restrictor 1236 is shown as a nozzle that accelerates flow as the fluid enters the motor power section. In other embodiments, a nozzle or other flow restrictor 1236 may be included as part of the motor (e.g., part of the stator housing), or attached in any other suitable manner.

Figure 13:
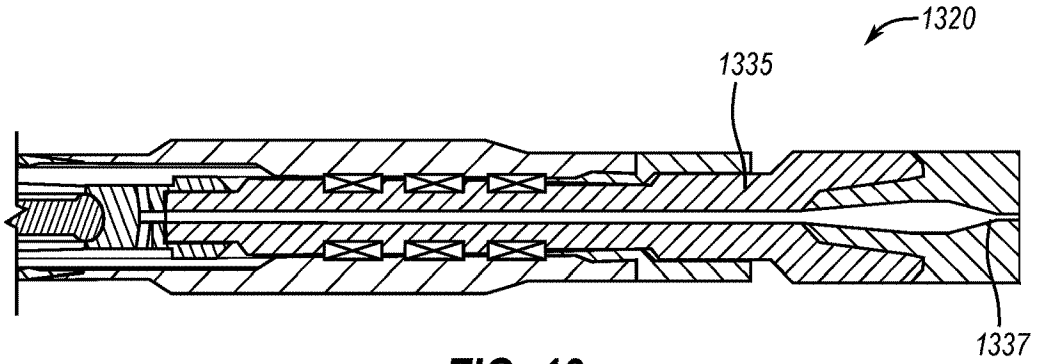
FIG. 13 is a partial cross-sectional view of an additional downhole motor, according to one or more embodiments of the present disclosure.

Likewise, to attenuate pressure perturbations, a flow restrictor may be positioned elsewhere in a motor (e.g., within or after the power or bearing sections). FIG. 13, for instance, illustrates a portion of a bearing section of a downhole motor 1320, where a flow restrictor 1337 is coupled to the bottom or distal end of the drive shaft 1335. The flow restrictor 1337 is shown as being within a separate collar attached to the drive shaft 1335, but the flow restrictor 1337 may be coupled to the drive shaft 1335 by being integral therewith through a machining, casting, additive manufacturing, or other process.

Regardless of the positioning of a nozzle or other flow restrictor within the motor (e.g., motor 1120, 1220, 1320), the flow restrictor can be used to produce a pressure drop driven by the flow. As the motor is running, an increase in torque can be produced as a reaction to an increase in the pressure drop across the motor. In terms of the hydraulic system, the rate of pressure change may occur quickly when compared to the acoustic travel time in the bottomhole assembly geometry. As a result, the water hammer equation (EQ. 1) can be used to estimate the flow rate change ($\Delta v$):

$$\Delta P = \rho c \Delta v \quad (1)$$

where c is the speed of sound in the fluid, ρ is the fluid density, and ΔP is the pressure drop. With a nozzle or other flow restrictor in line with the flow as the flow drops, so too will the pressure drop. This can attenuate pressure waves which propagate away from the motor to drive a weight-on-bit (WOB) change at the motor, or force change at other components. A simple model shows that under realistic conditions for a 4¾ in. (12 cm) motor, a nozzle with a pressure drop of 300 psi (2.1 MPa) would attenuate the pressure waves by 30-50%.

As discussed, the flow restrictor can be positioned in various locations, although in some embodiments, the flow restrictor is within 1, 2, 3, 5, or 10 meters of the rotor/stator. This allows the flow restrictor to be acoustically close to the rotor/stator as the speed of sound in drilling mud can sometimes be between 1000 and 1500 m/s. Potential locations for a flow restrictor include at the entrance to the motor drive shaft, within the motor drive shaft, or at the rotor catcher or float sub. Nevertheless, while installing the flow restrictor in the motor body or rotor catcher can be implemented in some embodiments, it can also be installed in a separate sub, such as by connecting the sub to the bottom or top of the motor.

To counter HFO in a steerable motor assembly, a bit below the motor can control the pressure below. In such a case, it may be desirable to place the flow restrictor just above the motor. To counter Type 1 (pressure driven) HFO—which can be evident in aggressive pressure driven push the bit systems—a flow restrictor below the motor may be used. For WOB driven, Type 2 HFO with a steering tool below a motor, the bottomhole assembly may use multiple flow restrictors, such as nozzles above and below the motor.

A flow restrictor such as a nozzle may be used to HFO, but can also cause an increased pressure drop across the motor and bottomhole assembly. In some cases, other damping approaches may be used that may not affect the pressure drop or may have reduced pressure drop.

Figure 14:
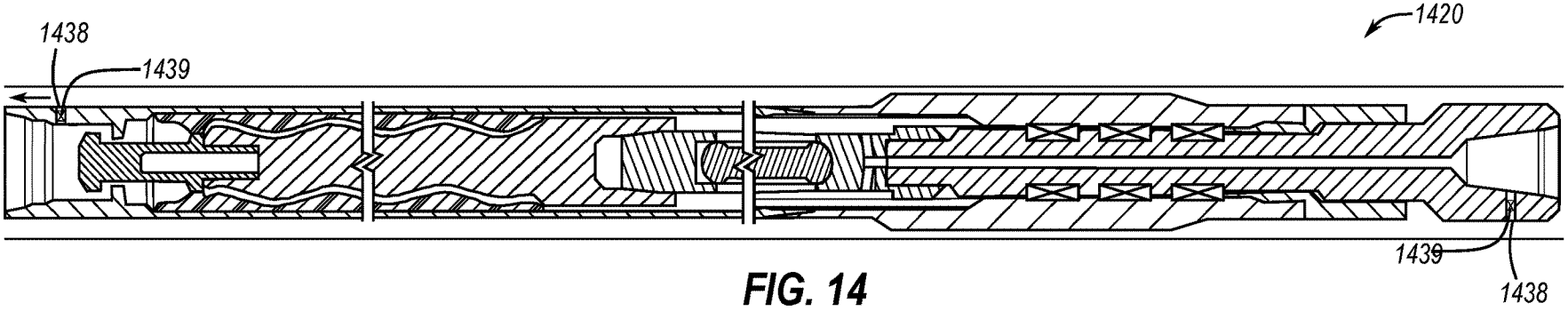
FIG. 14 is a cross-sectional view of an additional downhole motor, according to one or more embodiments of the present disclosure.

For example, flow may be designed to bypass the motor. FIG. 14, for instance, illustrates a motor 1420 similar to the motor 1020 of FIG. 10, but which includes a port 1438 in the collar in or above the power section of the motor 1420. As fluid enters the collar, a portion of the fluid can flow through the port 1438 and into the annulus of the wellbore, where it is returned to the surface. Flow through the port 1438 can be controlled by a valve 1439. The valve may operate electronically and be controlled by a microprocessor, or may be flow or pressure activated. For instance, when flow is within a particular range (or upon exceeding or dropping relative to a threshold), flow through the valve 1439 may be enabled. The valve may also be directional to allow flow only radially from the motor to the annulus. The directional flow may always be open, or may also be controlled.

A valved bypass across the motor 1420 or to the annulus can also be used to mitigate pressure pulsation amplitudes. In some cases, the valve 1439 can act as a pressure relief and be tuned to open and divert flow at the high frequencies, which may reduce the HFO pressure fluctuations at the motor. Operation of the valve 1439 can be passive and divert flow from inside the collar to the annulus. In other embodiments, the valve 1439 is active. For instance, the valve 639 can include a solenoid controlled by a pressure sensor and control circuit electronics.

In some cases, the valve 1439 is mounted in the collar and has a cone shape with a spring (e.g., a steel coil spring) and damper (e.g., rubber or another elastomer), and some mass. The mass (m), spring constant/stiffness (k), and c (speed of sound in fluid) can be tuned to match the expected HFO frequencies, with the damping giving a wide enough resonance to be sensitive to several harmonics in the system. In some embodiments, the valve 1439 and port 1438 are positioned close to the motor rotor, such as just above the rotor or rotor catcher.

The valve 1439 and port 1438 can instead be positioned in other locations. For instance, where the stick-out (distance from the drive shaft to the end of the bottomhole assembly) is short or the bottomhole assembly is driven by a motor, the valve 1439 and port 1438 can be placed below the motor, or in the motor shaft. Illustratively, an optional valve 1439 and port 1438 are also shown in FIG. 14 as being positioned in the drive shaft, but could also be in a sub below the shaft. In a lower position, the valve 1439 can reduce the pressure fluctuations across the drill bit, thereby maintaining a relatively constant pressure across the motor 1420. One feature of this configuration is that the motor power is not reduced.

Figure 16:
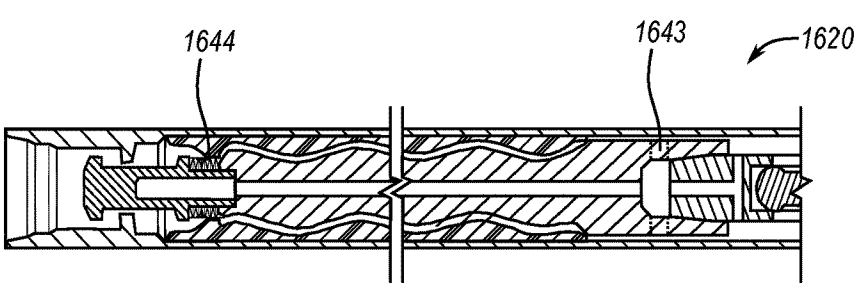
FIG. 16 is a partial cross-sectional view of an additional downhole motor, according to one or more embodiments of the present disclosure.

In another example embodiment, the valve and port can be placed in the rotor catcher, and a port can be machined or otherwise formed in the rotor (see, e.g., FIG. 16). Such a valve could then relieve pressure fluctuations by diverting flow through the center of the rotor rather than to the annulus. In another embodiment, the flow can be diverted through the stator (e.g., axially along the stator or through the stator to the annulus). Thus, a valved port can be positioned in the power section, bearing section, above the power section, below the bearing section, or even between the power and bearing sections of the motor 1420.

Figure 15:
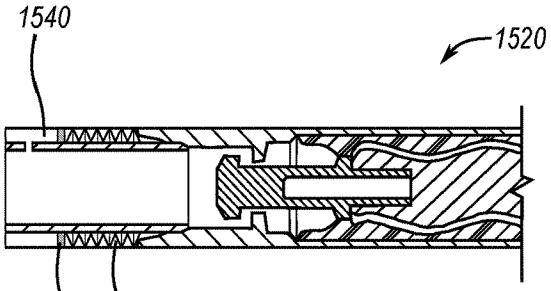
FIG. 15 is a partial cross-sectional view of a power section of a downhole motor, according to one or more embodiments of the present disclosure.

In still other embodiments, HFO can be addressed by adding compliance within the motor. FIG. 15, for instance, illustrates a portion of a power section of a motor 1520 similar to the motor 1020 of FIG. 10. In this embodiment, a collar above the motor 1520 includes a chamber 1540 that can enclose a compressible fluid. The chamber 1540 can be sealed and the compressible fluid can allow some compliance in the hydraulic system and dampen pressure oscillations (e.g., HFO). The fluid can be pre-pressurized above an on-bottom hydrostatic pressure before going downhole. In some cases the chamber can be a recess housing with a rubber balloon filled with an inert gas such as nitrogen (see FIG. 18). The chamber may also be positioned in the rotor catcher, or coupled to the rotor catcher.

The chamber 1540 may also be used in other manners. As shown in FIG. 15, for instance, a spring 1541 or other biasing element (e.g., helical spring, Bellville stack, etc.) can be positioned in the chamber 1540 and add some compliance. A port may allow fluid to flow into the housing and a piston 1542 can also compress the spring 1541. In some cases, the port is valved to allow flow at particular pressures or flow rates either into or out of the chamber 1540. For instance, the chamber 1540 may be filled with an incompressible fluid or a compressible fluid, and compliance in the spring 1541 may move the piston 1542 to cause fluid to be pushed out of the chamber 1540 or drawn into the chamber 1540.

In another example embodiment, the axial coupling of the rotor can be arranged with some compliance. This may allow minimizing the change in flow rate and pressure above and below the motor when there is a change in torque. FIG.

16, for example, shows a motor 1620 where a compliant section 1643 is positioned in the rotor near the connection to the flex shaft. Such a compliant section may allow a change to the axial coupling of the rotor and the flex shaft, and as the pressure across the rotor increases the rotor will be displaced to mitigate a change in flow rate.

Using the water hammer model and assuming a cross-section area ratio between the rotor and the inside of the collar, it can be estimated that a rotor displacement of 4 mm will mitigate a 1 bar pressure perturbation. Assuming a rotor of a 50 mm diameter, this could be achieved with a spring stiffness of 600 kN/m. A pre-tensioned stack of Belville washers may provide such a spring stiffness.

Figure 17:
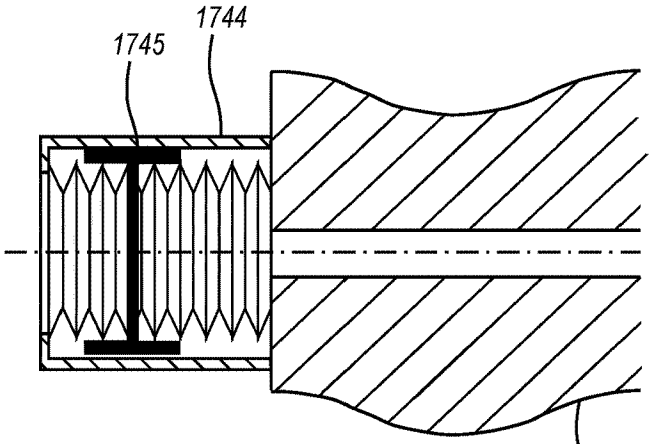
FIG. 17 is a schematic, cross-sectional view of a flow compliance assembly with a piston and housing attached to the top of a rotor, according to one or more embodiments of the present disclosure.

In another option for mitigating HFO, the rotor may be rigidly coupled to the flex shaft and drive system, but could have a compliant connection to the rotor catcher. In FIG. 16, for example, a compliant connection 1644 is illustrated between the rotor catcher and the rotor. FIG. 17 schematically illustrates this concept in additional detail, with a compliant section 1744 coupled to a top end of a ported rotor 1729. The compliant section 1744 can include a spring loaded piston 1745 that connects through the ported rotor 1729. Rather than the entire rotor moving, the piston 1745 can move to allow hydraulic compliance of the system. As the pressure drop increases (and the flow rate falls), the piston 1745 is displaced and more fluid is pumped from above the motor to below the motor. This can act as a high pass hydraulic filter.

Such a flow compliance assembly with a piston in a housing attached to the top of the rotor can use the Belville washer stack to provide measured compliance. A smaller stack can be used to provide back force and prevent rattling. A similar displacement and stiffness model can be used as for the rotor as discussed above. Additionally, if the mud that is used can gel in the rotor bypass, the spring constant can be modified to soften the springs, or to use a small nozzle to bleed a small amount of flow through the bypass to break the gel rather than for loss of fluid. A bellows system may also be used rather than the piston to reduce friction in the system.

The system described with respect to FIG. 17 contemplates compliance across the rotor 1729. In another embodiment, a similar assembly can be used but to connect flow from inside the collar (including the motor housing) to the flow in the annulus, either above or below the motor.

Figure 18:
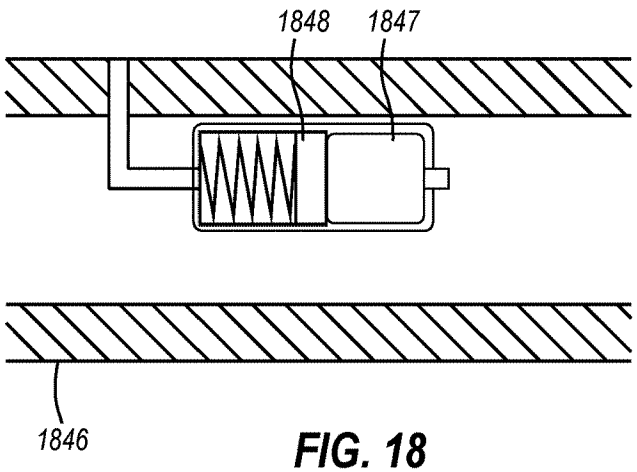
FIG. 18 is a schematic, cross-sectional view of a pressure relief, according to one or more embodiments of the present disclosure.

FIG. 18 illustrates an example that can operate as a type of pressure relief valve where when there is a pressure spike, there is fluid loss to the annulus. In the system of FIG. 18, the collar 1846 includes a port coupled to the valve, which includes a bladder 1847 and spring-loaded piston 1848. This type of device could be pressure compensated to work on a much higher range of differential pressures.

Figure 19:
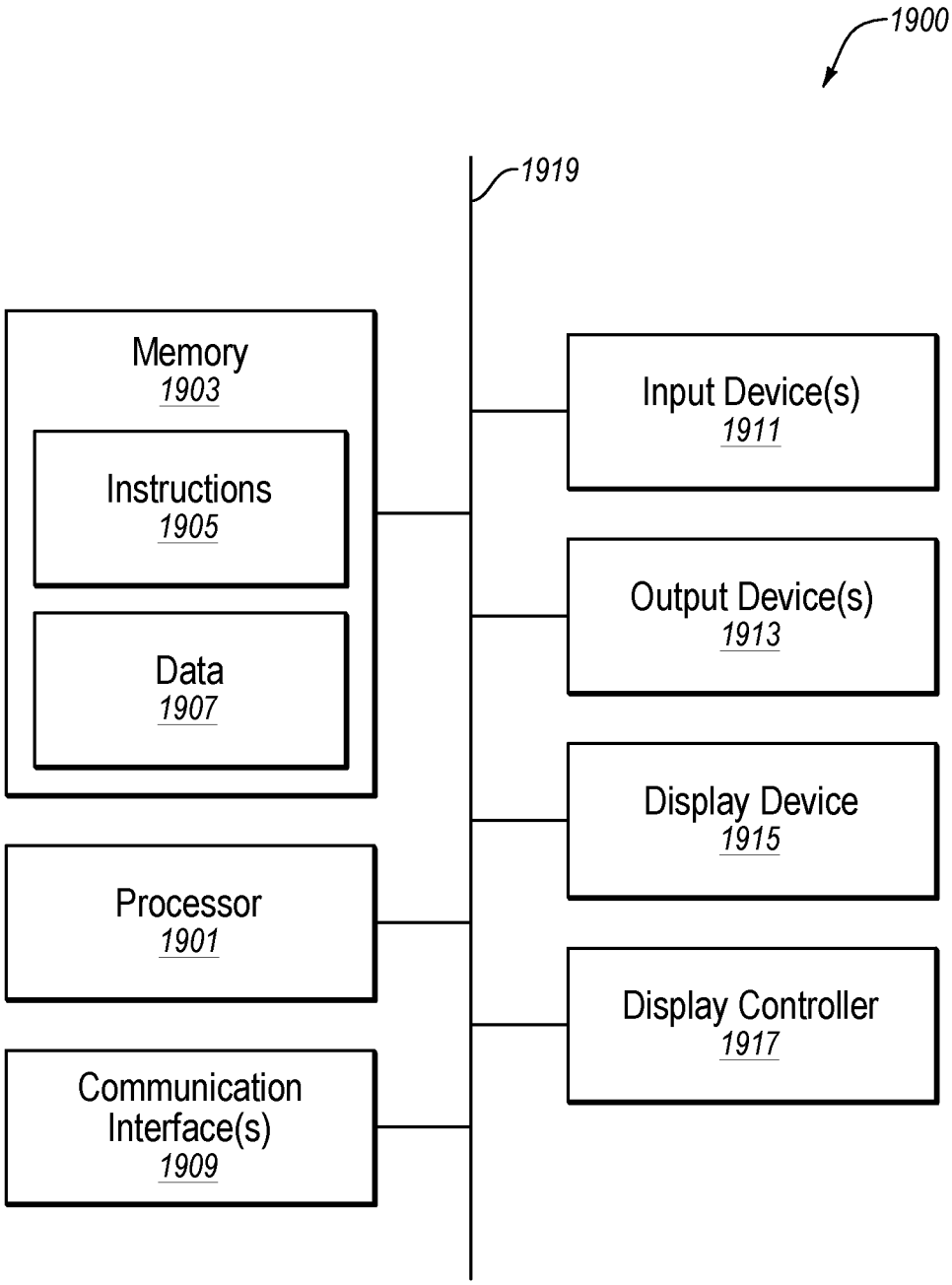
FIG. 19 is a representation of a computing system, according to at least one embodiment of the present disclosure.

FIG. 19 illustrates certain components that may be included within a computer system 1919. One or more computer systems 1919 may be used to implement the various devices, components, and systems described herein.

The computer system 1919 includes a processor 1901. The processor 1901 may be a general-purpose single or multi-chip microprocessor (e.g., an Advanced RISC (Reduced Instruction Set Computer) Machine (ARM)), a special purpose microprocessor (e.g., a digital signal processor (DSP)), a microcontroller, a programmable gate array, etc. The processor 1901 may be referred to as a central processing unit (CPU). Although just a single processor 1901 is shown in the computer system 1919 of FIG. 19, in an alternative configuration, a combination of processors (e.g., an ARM and DSP) could be used.

The computer system 1919 also includes memory 1903 in electronic communication with the processor 1901. The memory 1903 may be any electronic component capable of storing electronic information over a short or extended period of time. For example, the memory 1903 may be embodied as random access memory (RAM), read-only memory (ROM), magnetic disk storage media, optical storage media, flash memory devices in RAM, on-board memory included with the processor, erasable programmable read-only memory (EPROM), electrically erasable programmable read-only memory (EEPROM) memory, registers, and so forth, including combinations thereof.

Instructions 1905 and data 1907 may be stored in the memory 1903. The instructions 1905 may be executable by the processor 1901 to implement some or all of the functionality disclosed herein, including all or portions of methods of mitigating HFO. Executing the instructions 1905 may involve the use of the data 1907 that is stored in the memory 1903. Any of the various examples of modules and components described herein may be implemented, partially or wholly, as instructions 1905 stored in memory 1903 and executed by the processor 1901. Any of the various examples of data described herein may be among the data 1907 that is stored in memory 1903 and used during execution of the instructions 1905 by the processor 1901.

A computer system 1919 may also include one or more communication interfaces 1909 for communicating with other electronic devices. The communication interface(s) 1909 may be based on wired communication technology, wireless communication technology, or both. Some examples of communication interfaces 1909 include a Universal Serial Bus (USB), an Ethernet adapter, a wireless adapter that operates in accordance with an Institute of Electrical and Electronics Engineers (IEEE) 802.11 wireless communication protocol, a BLUETOOTH® wireless communication adapter, and an infrared (IR) communication port. The processor 1901 can, in some embodiments, receive instructions or data over the communication interface(s) 1909 for processing in addition to, or in lieu of, the instructions 1905 or data 1907 in memory 1903.

A computer system 1919 may also include one or more input devices 1911 and one or more output devices 1913. Some examples of input devices 1911 include a keyboard, mouse, microphone, remote control device, button, joystick, trackball, touchpad, and lightpen. Some examples of output devices 1913 include a speaker and a printer. One specific type of output device that is typically included in a computer system 1919 is a display device 1915. Display devices 1915 used with embodiments disclosed herein may utilize any suitable image projection technology, such as liquid crystal display (LCD), light-emitting diode (LED), gas plasma, electroluminescence, or the like. A display controller 1917 may also be provided, for converting data 1907 stored in the memory 1903 into text, graphics, and/or moving images (as appropriate) shown on the display device 1915.

The various components of the computer system 1919 may be coupled together by one or more buses, which may include a power bus, a control signal bus, a status signal bus, a data bus, etc. For the sake of clarity, the various buses are illustrated in FIG. 19 as a bus system 1919.

INDUSTRIAL APPLICABILITY

The embodiments of the HFTO mitigation systems have been primarily described with reference to wellbore drilling operations; however, HFTO mitigation systems described herein may be used in applications other than the drilling of a wellbore. In other embodiments, HFTO mitigation systems according to the present disclosure may be used outside a wellbore or other downhole environment used for the exploration or production of natural resources. For instance, HFTO mitigation systems of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment. Other downhole environments (e.g., wireline, production, subsea, formation testing, hydraulic fracturing, etc.) may also benefit from aspects described herein, as well as further industries, including manufacturing/machining industries. In some embodiments, aspects of the present disclosure can be used to mitigate the damage HFO causes on a system, or even limiting the extent to which HFO occurs in a system.

For instance, a method for mitigating damage caused by torsional oscillations can include identifying one or more contact points where a system is likely to have a contact point. As discussed herein, this can relate to Type 2 HFTO which occurs in a bending scenario. The identification of the one or more contact points may be identified in any suitable manner, including by modeling bending of the system (e.g., downhole system), by reviewing sensor data or tool health of similar tools, or the like. The contact points may be associated with locations of torsional oscillation, such as torsional oscillation nodes. The design of the system may then be modified to include oscillation mitigation components at or near the one or more identified contact points. Such mitigation components can act to change a torsional vibration profile of the system. The changes may include moving a torsional oscillation node. The node may be moved away from a vulnerable component, or in a downhole system may be moved in an uphole direction nearer the surface of a wellbore. This process may be iterated multiple times in order to move contact points to a desired location where damage is less likely either because the node is at a less vulnerable location, or because the frequency has been reduced to minimize strain/fatigue concerns.

When modeling is performed, or the type/extent of torsional oscillation is determined, various factors can be considered. In a downhole environment, for instance, at least one of weight on the downhole system, curvature of a wellbore, downhole tool configuration, downhole fluid composition, or downhole formation characteristics may be evaluated. The downhole system that is evaluated and modified can include a rotary steerable tool and, as a result of the modification, a torsional vibration node may be moved above the rotary steerable tool. For instance, a pair of nodes may identified (e.g., one at a drill bit and one at the rotary steerable tool), and the node at the rotary steerable tool can be moved by using the mitigation component. As a result of the mitigation, a peak displacement of the HFO waveform can be located at or above the rotary steerable tool.

Similar modifications can also be used for a downhole system with additional or other tools. For instance, one or more mitigation components can be added to move an oscillation node away from (e.g., uphole of) an MWD or LWD, and a peak displacement location may also be at or above the MWD or LWD.

In modeling or considering torsional oscillations, at least two types of torsional vibrations can be considered. One such type may include a first type that is pressure dependent and/or associated with vertical or lateral movement/drilling. A second type can be pressure independent and/or associated with curved movement/drilling. The first type may also be associated with systems that include a motor, where the second type is independent of a motor, and present whether or not a motor is present. When modifying the system, the modified nodes may be nodes of the second type of vibration. Optionally, the two types of torsional vibration are mutually exclusive. In this sense, the same system can experience both types of torsional vibration at different times, but only one type has a significant presence at particular location a given time.

To move an oscillation node (e.g., one or both nodes of a waveform), a mitigation component may include a contact component. The contact component can include a radially extended wear surface, a radially extended rotating surface, or both. The radially extended wear or rotating surface may have a location of less than 18 in. (46 cm) to prevent the contact from operating as an oscillation node, but may also be shorter. Other contact components may be less dependent on length, but may decrease friction in other manners to prevent the contact from operating as an oscillation node.

When one oscillation node is moved, the waveform changes. For instance, moving nodes apart extends the period and decreases the frequency of the waveform. Changing the period may move maximum strain or displacement locations away from a vulnerable location. Changing frequency may reduce strain or fatigue at vulnerable locations. Notably, while a single node may moved, multiple nodes may also be moved. For instance, a bit, underreamer, or other cutting tool may be at a location forming a contact point/oscillation node, and the location can remain fixed. However, an associated/adjacent contact point with sufficient length/friction to form an oscillation node may be moved to change the waveform by moving one oscillation node. In another case, two adjacent contact points may be identified above a cutting tool (for instance), and one or both may be moved to change the waveform.

In some cases, a physics-based modeling system may be used. For instance, contact points can be identified by modeling using a dynamic drilling simulation as a transient time simulation based on time or incremental rotation of the downhole system. Results of modeling or other identification of contact points can be produced and displayed. For instance, a contact point may be displayed, or optionally only contact points that form oscillation nodes may be displaced (e.g., based on given operational, formation, or wellbore characteristics). A single node may be shown, or associated pairs of contact points may be displayed. The modified design of a downhole system, or options for modifying the system may also be displayed. A suitable or selected modified system may then also be constructed and used in a drilling, production, wireline, formation testing, subsea, or other downhole system.

Certain examples described herein include a method A of mitigating high frequency torsional oscillation in a curved wellbore, and include: identifying one or more contact points of a downhole drilling system in the curved wellbore; evaluating whether at least one of the one or more contact points are likely to form a torsional oscillation node of a pair of torsional oscillation nodes for a type of high frequency torsional oscillation specific to curved wellbores; and where the at least one contact point is likely to form the torsional oscillation node of the pair of oscillation nodes, modifying a design of the downhole drilling system to include a radially extending contact surface at or near the at least one contact point.

In another example, the method A can further include building the downhole drilling system with the radially extended contact at the at least one contact point.

In another example, the method A can further include iterating the steps of identifying, evaluating, and modifying and thereby including a plurality of radially extending contact surfaces. Iterating optionally further causes the pair of torsional oscillation nodes to have an upper torsional oscillation mode that iteratively moves toward a wellbore surface.

Certain additional examples described herein include a method B for mitigating torsional oscillation, and include: preparing a bending model for a bottomhole assembly (BHA) performing drilling operations a dogleg of a wellbore; identifying one or more contact regions of an outer surface of the bottomhole assembly (BHA) with a wellbore wall in the dogleg, the one or more contact regions defining an oscillation node of the BHA; and transferring the oscillation node uphole by modifying a design of the BHA and thereby changing a contact region such that it does not act as an oscillation node.

In another example, transferring the oscillation node uphole in method B includes transferring the oscillation node uphole of a downhole tool in the BHA and/or radially offsetting the BHA from the wellbore wall with a wear band connected to an outer surface of the BHA. The downhole tool optionally includes at least one of a rotary steerable system, an MWD, or an LWD.

In another example, changing the contact region in method B includes at least one of reducing a contact length of the contact region on the wellbore wall or reducing friction of the contact region on the wellbore wall.

In additional example embodiments, a method C for configuring a downhole motor system includes: determining high frequency oscillations (HFO) in a downhole system; considering a combination of HFO mitigation mechanisms and placements for achieving reduction of the HFO; selecting at least one HFO mitigation mechanism type and placement; and assembling the downhole system with the selected type of HFO mitigation mechanism at the selected location. The downhole system optionally is or includes at least one of a mud motor or RSS system.

In another example, considering the combination of HFO mitigation mechanisms and placements in method C is based on achieving reduction of axial HFO.

In another example, selecting the at least one HFO mitigation mechanism type and placement in method C includes selecting one or more of: a flow restriction in or leading to a drive shaft of a motor of the downhole system; a flow restriction above a rotor of the motor; a flow restriction below the drive shaft of the motor; a bypass to an annulus above the rotor; a bypass to an annulus in or below the drive shaft; a bypass through a center of the rotor; an axially compliant construction between a rotor and flex shaft of a motor of the downhole system; an axially compliant construction between a rotor and a collar above the rotor; or an axially compliant construction between the rotor and a rotor catcher.

In additional example embodiments, a downhole motor D includes: a power section having a rotor and stator; a bearing section coupled to the rotor and stator, the bearing section including a drive shaft; and a flow restriction positioned to restrict axial flow through the downhole motor.

In another example, the flow restriction of downhole motor D includes a nozzle that is optionally passive or active. Optionally, the flow restriction is positioned in or leading to the drive shaft, above the rotor, or below the drive shaft. In some examples, the flow restriction is flow rate dependent.

In additional example embodiments, a downhole motor E includes: a power section having a rotor and stator; a bearing section coupled to the rotor and stator, the bearing section including a drive shaft; and a bypass system arranged and design to flow fluid from above the rotor to an annulus, from the drive shaft to the annulus, or from above the rotor and through the rotor without passing through cavities radially between the rotor and stator.

In additional example embodiments, a downhole motor F includes: a power section having a rotor and stator; a bearing section coupled to the rotor and stator, the bearing section including a drive shaft; and a compliant element positioned between the rotor and the bearing section.

In some embodiments, the compliant element of motor F is or includes at least one of: pressure balanced; a piston communicating with flow below the rotor through a ported rotor; or allows compliance at an axial coupling in a bearing stack of the bearing section, in or coupled to the rotor, or in or coupled to a rotor catcher coupled to the rotor.

In some embodiments, a method G for mitigating high frequency oscillation (HFO) includes: identifying one or more contact points associated with following a trajectory of a wellbore in a downhole system; based on the identified one or more contact points, identifying at least one oscillation node corresponding to contact with a wall of the wellbore at the one or more contact points; and modifying a design of the downhole system based on the at least one oscillation node, thereby (i) damping vibration at a location spaced away from the at least one oscillation node and/or (ii) moving a first oscillation node of the at least one oscillation node.

In some aspects, the downhole system of a method A-C or G includes a rotary steerable system, and moving the first oscillation node of the at least one oscillation node includes moving the first oscillation node toward a surface of the wellbore and from a location at or below the rotary steerable system to a location above the rotary steerable system.

In some aspects, a method A-C or G further includes identifying at least one type of high frequency oscillation at the first oscillation node, and which is independent of a presence of a downhole motor, independent of pressure, or limited to curved portions of the trajectory.

In some aspects, a method A-C or G further includes constructing the downhole system according to the modified design.

In some aspects, identifying one or more contact points in a method A-C or G includes modeling bending of the downhole system in the trajectory. Modeling bending of the downhole system can include includes performing a dynamic drilling simulation as a transient time simulation based on time or incremental rotation of the downhole system.

In some aspects, a method A-C or G further includes displaying at least one of (i) results of modeling bending of the downhole system, (ii) the identified one or more contact points, (iii) the identified at least one oscillation node, (iv) contact of the downhole system with the wall of the wellbore; or (v) an oscillation mode associated with the first oscillation node.

In some aspects, a method A-C or G further includes, based on identifying the at least one oscillation node, determining an installation location of an HFO mitigation mechanism on the downhole system. The HFO mitigation mechanism can be installed on an outer surface of the downhole system at the first oscillation node, by including an energy damping component at a location spaced away from the at least one oscillation node, or by including an energy damping component with a radially extended surface on an outer surface of the energy damping component at the first oscillation node. An HFO mitigation mechanism on an outer surface of the downhole system or energy damping component can extend radially at least 1.3 mm from the outer surface and have an axial length of less than 46 cm. The installation location can thus be at the at least one oscillation node or spaced from the at least one oscillation node.

In some aspects, modifying the design of the downhole system in a method A-C or G includes placing an HFO mitigation mechanism on the downhole system at the first oscillation node and thereby reducing at least one of a length of a contact region at the first oscillation node or friction at the first oscillation node. The HFO mitigation mechanism can include one or more of a fixed wear sleeve on an outer surface of the downhole system, a rotating wear sleeve on an outer surface of the downhole system, a fixed stabilizer, a rotating stabilizer, or one or more rollers on the outer surface of the downhole system.

In some aspects, an HFO mitigation mechanism in a method A-C or G includes at least two HFO mitigation mechanisms on the downhole system, and determining an installation location of an HFO mitigation mechanism on the downhole system includes identifying two installation locations that are separated by at least 2.4 m.

One or more specific embodiments of the present disclosure are described herein; however, these described embodiments are examples of the presently disclosed techniques. Additionally, in an effort to provide a concise description of these embodiments, not all features of an actual embodiment are described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A method for mitigating torsional oscillation, comprising:

identifying one or more contact points associated with following a trajectory of a wellbore in a downhole system;

based on the identified contact points, identifying at least one oscillation node at one or more contact regions with a wall of the wellbore;

determining the at least one oscillation node is a pressure independent node; and based on determining the at least one oscillation node is the pressure independent node, modifying a design of the downhole system at the one or more contact regions, thereby moving a first oscillation node of the at least one oscillation node, wherein modifying the design of the downhole system comprises controlling flow associated with one or more components of a motor assembly.

2. The method of claim 1, wherein the downhole system includes a rotary steerable system, and wherein the first oscillation node is moved toward a surface of the wellbore and from a location at or below the rotary steerable system to a location above the rotary steerable system.

3. The method of claim 1, wherein identifying the one or more contact points includes identifying a type of high frequency oscillation (HFO) at the first oscillation node, wherein the type of HFO is one or more of independent of a presence of a downhole motor, independent of pressure, or limited to curved portions of the wellbore.

4. The method of claim 3, wherein the type of HFO is a second type and is mutually exclusive of a first type that is dependent on a presence of the downhole motor.

5. The method of claim 1, wherein identifying one or more contact points includes modeling bending by performing a dynamic drilling simulation as a transient time simulation based on time or incremental rotation of the downhole system.

6. The method of claim 1, further comprising modeling bending following the trajectory of the wellbore, and wherein the one or more contact points are identified from the modeled bending.

7. The method of claim 1, wherein the one or more contact points are identified using a model configured to simulate bending the downhole system, using knowledge from prior drilling tools, or both.

8. The method of claim 1, wherein controlling the flow comprises adjusting a fluid flow that drives a power section of the motor assembly at least by selectively restricting the fluid flow upstream or downstream from the motor assembly, selectively diverting the fluid flow to bypass the motor assembly, or any combination thereof.

9. The method of claim 1, wherein controlling the flow comprises controlling the flow with a flow restriction in or leading to a drive shaft of the motor assembly, a flow restriction above a rotor of the motor assembly, a flow restriction below the drive shaft of the motor assembly, a bypass to an annulus above the rotor of the motor assembly, a bypass to an annulus in or below the drive shaft of the motor assembly, a bypass through a center of the rotor of the motor assembly, or any combination thereof.

10. A method for mitigating damage from high frequency oscillation (HFO), comprising:

identifying one or more contact points of a downhole drilling system;

using the identified one or more contact points, identifying one or more contact regions of the downhole drilling system with a wellbore wall, wherein the one or more contact regions form at least one oscillation node independent of pressure; and based on the identified one or more contact regions, determining an installation location of an HFO mitigation mechanism on the downhole drilling system to modify an HFO waveform of the downhole drilling system, wherein modifying the HFO waveform comprises controlling flow associated with one or more components of a motor assembly.

11. The method of claim 10, further comprising installing the HFO mitigation mechanism on an outer surface of a bottomhole assembly (BHA) of the downhole drilling system at the installation location.

12. The method of claim 10, wherein identifying the one or more contact regions includes identifying the one or more contact regions of the downhole drilling system in a curved section of a wellbore.

13. The method of claim 10, wherein the HFO mitigation mechanism includes a wear band and the installation location is an outer surface of the downhole drilling system, the wear band reducing at least one of a length of the one or more contact regions or friction at the one or more contact regions.

14. The method of claim 13, wherein the wear band extends radially at least 0.05 in. (1.3 mm) from the outer surface, and the wear band has an axial length of less than 18 in. (46 cm).

15. The method of claim 10, wherein the HFO mitigation mechanism includes a plurality of HFO mitigation mechanisms, wherein at least two HFO mitigation mechanisms of the plurality of HFO mitigation mechanisms are separated by at least 8 ft (2.4 m).

16. The method of claim 10, further comprising modeling bending following a trajectory of the wellbore, and wherein the one or more contact points are identified from the modeled bending.

17. A method for mitigating torsional oscillation, comprising:

preparing a bending model for a bottomhole assembly (BHA) performing drilling operations in a dogleg of a wellbore;

identifying one or more contact regions of an outer surface of the BHA with a wellbore wall in the dogleg, the one or more contact regions defining at least one oscillation node of the BHA;

determining the at least one oscillation node is a pressure independent node; and based on determining the at least one oscillation node is the pressure independent node, transferring at least a first oscillation node of the at least one oscillation node uphole by modifying a design of the BHA and thereby changing the one or more contact regions such that they do not act as the first oscillation node, wherein modifying the design of the BHA comprises controlling flow associated with one or more components of a motor assembly.

18. The method of claim 17, wherein transferring at least the first oscillation node uphole includes at least one of transferring the first oscillation node uphole of a downhole tool in the BHA or radially offsetting the BHA from the wellbore wall with a wear band connected to an outer surface of the BHA, or wherein changing the one or more contact regions includes at least one of reducing a contact length of the one or more contact regions on the wellbore wall or reducing friction of the one or more contact region on the wellbore wall.

19. The method of claim 17, wherein controlling the flow comprises adjusting a fluid flow that drives a power section of the motor assembly at least by selectively restricting the fluid flow upstream or downstream from the motor assembly, selectively diverting the fluid flow to bypass the motor assembly, and selectively adjusting a flow rate and pressure above and below the motor assembly via a compliant section of the motor assembly, wherein the compliant section is configured to change an axial coupling of a rotor of the motor assembly to cause displacement of the rotor of the motor assembly.

20. The method of claim 17, wherein controlling the flow comprises controlling the flow with a flow restriction in or leading to a drive shaft of the motor assembly, a flow restriction above a rotor of the motor assembly, a flow restriction below the drive shaft of the motor assembly, a bypass to an annulus above the rotor of the motor assembly, a bypass to an annulus in or below the drive shaft of the motor assembly, a bypass through a center of the rotor of the motor assembly, or any combination thereof.

* * * * *